US010507941B2

(12) United States Patent
Seversky et al.

(10) Patent No.: US 10,507,941 B2
(45) Date of Patent: Dec. 17, 2019

(54) LID STORAGE AND APPLICATION DEVICE

(71) Applicants: Michael Seversky, Webster, NY (US); Michael DiCocco, Wayne, NJ (US); Kristofer Stichter, Lebanon, PA (US)

(72) Inventors: Michael Seversky, Webster, NY (US); Michael DiCocco, Wayne, NJ (US); Kristofer Stichter, Lebanon, PA (US)

( * ) Notice: Subject to any disclaimer, the term of this patent is extended or adjusted under 35 U.S.C. 154(b) by 264 days.

(21) Appl. No.: 15/809,149

(22) Filed: Nov. 10, 2017

(65) Prior Publication Data

US 2018/0134424 A1 May 17, 2018

Related U.S. Application Data

(60) Provisional application No. 62/497,213, filed on Nov. 14, 2016.

(51) Int. Cl.
*B65B 7/28* (2006.01)
*B65B 67/02* (2006.01)

(52) U.S. Cl.
CPC ..... *B65B 7/2807* (2013.01); *B65B 7/2842* (2013.01); *B65B 67/02* (2013.01)

(58) Field of Classification Search
CPC ..... B65B 67/02; B65B 7/2842; B65B 7/2807; A47K 10/424
USPC ..... 53/305, 307; 221/221, 222, 223
See application file for complete search history.

(56) References Cited

U.S. PATENT DOCUMENTS 1,989,039 A * 1/1935 Geyer ..... B65B 7/2807 53/310
2,712,893 A * 7/1955 Charland ..... B65B 7/2842 53/310
2,768,491 A * 10/1956 Gatheridge ..... B65B 7/2807 53/310
3,029,574 A * 4/1962 Anderson ..... B65B 3/32 53/281
3,975,886 A * 8/1976 Waters ..... B65B 7/28 53/310
5,251,426 A * 10/1993 Heisler ..... B65B 7/2807 53/168
5,890,349 A * 4/1999 Heisler ..... B65B 57/02 53/314
6,161,367 A * 12/2000 Walter ..... B65B 7/2807 53/133.3
2007/0261370 A1* 11/2007 Marshall ..... B65B 7/2842 53/329
2010/0011713 A1* 1/2010 Denis ..... B65B 7/2842 53/485
2013/0226338 A1* 8/2013 Pickett ..... G07F 13/10 700/235

* cited by examiner

*Primary Examiner* — Michelle Lopez
*Assistant Examiner* — Chinyere J Rushing-Tucker
(74) *Attorney, Agent, or Firm* — Tracy Jong Law Firm; Tracy P. Jong; Cheng Ning Jong

(57) ABSTRACT

A stand-alone manually operated device for capping a filled beverage container with a lid. Lids are staged within the apparatus in a bulk storage queue and are individually transferred from a bulk storage queue and applied to a beverage container by physical contact to the application mechanism. The mechanism ensures the sealing rim of the lid is completely engaged on the beverage container without human contact on hygienic surfaces. Once the operator disengages, the mechanism automatically retracts to a resting position and the next lid is engaged.

20 Claims, 21 Drawing Sheets

LID STORAGE AND APPLICATION DEVICE

PRIORITY CLAIM AND RELATED APPLICATIONS

This non-provisional application claims the benefit of priority from provisional application U.S. Ser. No. 62/497,213 filed on Nov. 14, 2016. Said application is incorporated by reference in its entirety.

BACKGROUND OF THE INVENTION

1. The Field of the Invention

The present invention relates to a device for storing and applying lids to cups. More specifically, the present invention is directed to a device for storing and applying lids to beverage containers or cups.

2. Background Art

Restaurants, especially those catering to fast food and drinks have traditionally been focusing on improving packaging of food items and drinks so that the purchased food and drinks may be enjoyed at the restaurant and also taken out to be enjoyed elsewhere. A food and drink item meant to be a "take-out" item must be properly packaged and contained properly. Efforts in reducing costs for providing these convenience items have resulted in food and drink packaging that will only survive a short duration upon the commencement of their use. Traditionally, either a disposable plastic or paper cup is provided to receive beverages of a consumer's choice before the cup is sealed with a lid. Stacks of lids are typically provided at a self-serve restaurant so that patrons can access them and pick out appropriately-sized lids for their cups. In doing so, a messy, unsanitary and wasteful condition can be created. First, lids of various sizes may be provided for cups of different sizes. When presented with lids for various sized cups, a patron tends to simply pick up a lid before determining whether the lid that has been picked up is meant for the cup in hand. If the lid is unsuitable, then the patron may proceed to return the wrong lid to the same stack after exposing the lid to the patron's hand, soiled cup or other countertop surfaces. The next patron may find the wrong lid soiled and proceed to discard it. Further, the use of an incorrectly-sized lid may cause spills as the patron may try to fit the lid over a cup that is either too big or too small. Further, a patron may apply excessive force in an attempt to ensure that a lid has been properly applied, causing the cup to collapse and spilling the contents of the cup. Inefficiencies caused in a drink serving area can leave an unsanitary condition and an unwelcoming scene in addition to lost profits due to wastes and the need to clean up the area. Yet further, in food service areas, e.g., service stations and small cafes, management of peripheral items, e.g., lids cannot be attended to at regular intervals due to staffing availability. Yet further, a patron may try to fit a correctly size lid but may not achieve a uniform seal on the cup lid when applied manually leading to a lid to cup bond that may leak on the patron. These environments must rely on a device to manage lid stock and lid application in order to maintain sanitary conditions. Other users that may face challenges seating lids and can benefit from a device that aid in seating lids include beverage servers. e.g., coffee baristas and servers of drive-through food services, etc.

There arises a need for a drink establishment that is hygienic where the beverage cups may be sealed using a sanitary and reliable method without requiring a tremendous capital investment. Disclosed herein is a container lid application device configured to solve the problems disclosed elsewhere herein.

SUMMARY OF THE INVENTION

In accordance with the present invention, there is provided a container lid application device for applying a lid onto a container, the lid application device including:

(a) a dispense assembly configured for indexing the lid from a magazine of lids in a first orientation, the dispense assembly including at least two magazine support segments biased toward one another forming an opening, each of the at least two magazine support segments is coupled to a plunger such that when the plunger is urged upwardly, the opening is widened to release the bottommost lid of the magazine of lids before the opening contracts to support the other lids of the magazine of lids;

(b) a press assembly including:

(i) a lid grasping ring disposed in a plane, the lid grasping ring including a ring member configured for receiving the bottommost lid, the ring member having an opening of a first diameter, and (ii) a handle attached to a support ring within which the lid grasping ring is disposed;

(c) a transport assembly including:

(i) a guide slideably attached to the support ring, the guide configured for guiding the support ring to the container at a first position in a first direction;

(ii) a return spring attached to the support ring, wherein the return spring is configured to return the support ring to a second position in a second direction opposite to the first direction, and (d) a rotator assembly including at least one pin connected to the lid grasping ring at a first end and a pinion at a second end and a rack, the pinion configured to be rotatable about a central axis of said pin and rotatably coupled with said rack, wherein said rotator assembly is configured for rotating said lid grasping ring to a second orientation that is disposed at about 180 degrees with respect to said first orientation while said press assembly is moved between said first position and said second position, wherein, when the handle is pulled away from the second position towards the first position with a force, the plunger drops downwardly, the released bottommost lid is received in the opening of the ring member, the released bottommost lid is rotated by the rotator assembly while being transported by the transport assembly before arriving at the first position such that the released bottommost lid is securable to the container by the press assembly.

In one embodiment, the present device further includes a force limiter configured for bridging the handle and the lid grasping ring, the force limiter includes a resilient member having two ends, a first end of the resilient member is attached to the handle and a second end of the resilient member is attached to the support ring, wherein if the force exceeds a pre-determined threshold, the handle is rotated about the resilient member in the first direction to prevent continued application of the force and wherein if the handle is released, the press assembly is returned to the second position by the return spring, urging the plunger upwardly to release a next bottommost lid into the opening of the ring member.

In one embodiment, the press assembly further includes a protruding ring disposed in a plane, the protruding ring having an opening of a second diameter that is smaller than the first diameter, the protruding ring is disposed in a plane that is parallel to and at an offset to a plane of the lid grasping ring, wherein the protruding ring is configured to come in contact with a portion of the released bottommost lid such that the force can be uniformly applied on the released bottommost lid to secure the released bottommost lid to the beverage container.

In one embodiment, the resilient member is a torsion spring. In another embodiment, the resilient member is a flexible rod. In yet another embodiment, the resilient member is a coil spring.

In one embodiment, the force is exerted manually.

In one embodiment, wherein the transport assembly further includes a pulley system adapted to cycle the transport assembly between the first position and the second position without a manual effort.

An object of the present invention is to provide a lid application device capable of consistently sealing the mouth of a cup without causing spills or damage to the cup.

Another object of the present invention is to provide a lid application device which does not require electrical power for its operation.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
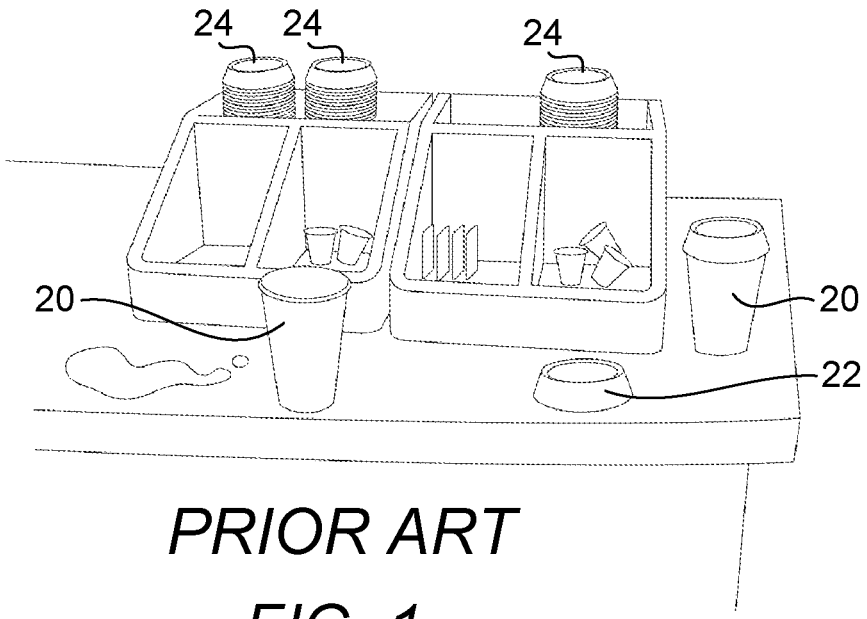
PRIOR ART FIG. 1
FIG. 1 is a conventional setting of a beverage fulfilment center at a self-serve restaurant, depicting a condition where beverages may be spilled and beverage containers or lids are strewn about and wasted.

2—beverage lid storage and application device
4—dispense assembly
6—press assembly
8—transport assembly
10—spring
12—protruding ring
14—cup holder
16—cup retainer springs
18—handle
20—cup
22—cup lid
24—cup lid magazine
26—bushing
28—guide
30—lid grasping ring
32—cup lid magazine support segment
34—slot of beverage cup lid magazine support segment
36—plunger
38—cutout
40—spring
42—ring member
44—pin
46—pinion
48—rack
50—opening
52—magnet
54—resilient member, e.g., torsion spring
56—sealing rim
58—cup lip
60—magazine shield
62—housing
64—rotator assembly
66—return spring
68—support ring
70—pulley
72—motor
74—belt
76—attachment point

PARTICULAR ADVANTAGES OF THE INVENTION

Advantages of the present invention include, but are not limited to, eliminating the need for human contact with beverage lids during selection from lid storage and application to the container, complete engagement of the beverage lid with the beverage container, and the device is powered entirely by physical user input. The magazine of lids is enclosed within a shield of the device, which prevents human contact with unused lids. Each lid is transferred from a dispense assembly to a press assembly without human contact with unused lids. Each lid is directly applied to a beverage container by the press assembly, which prevents human contact with the lid during application.

In one embodiment, the press assembly applies uniform force around the periphery of a lid such that it can be applied to the mouth of a cup, ensuring that lid engages the entire perimeter of the cup opening, preventing lid failure as well as beverage leakage or spillage. In each pressing action, the press assembly of the present device enables a consistent pressing force to be applied to the lid in order to seat the lid to close the mouth of a cup, allowing a proper closure without undue force that can crush the cup. Excessive downward force applied to a cup is deflected by a mechanism that allows the handle used for moving the press assembly to the cup to bend, thereby diminishing the user's capability in further applying downward force to the press assembly which can crush the cup.

A user of a present device is not concerned with the steps required to seat a lid atop a cup. A self-explanatory linear action is all that is required to dispense a lid from a magazine of lids, bring the lid to a cup and to seat the lid so as to close the mouth of a cup. The present device can consistently dispense a lid from a magazine of lids and seat the lid all in a single slide action.

In one embodiment, the present device is powered by a human force without input from electric, pneumatic, hydraulic, or other power sources, allowing placement of the device to be independent of new or existing power sources and therefore can be set up on any surfaces accessible and convenient to users.

The present device is configured to receive a magazine of lids and dispenses one lid at a time for each linear slide action, making the action to seat a lid to close the mouth of a beverage container or cup uncomplicated. Further, upon seating a lid, no effort is required of the part of a user to return to the device to a position such that the next lid seating action can be carried out again as the press assembly of the device is automatically returned to be replenished with the next lid once the press assembly has been released by a user.

The present device is capable of achieving a lid application cycle time that is less than hand application cycle time with complete sealing of the mouth of a cup.

DETAILED DESCRIPTION OF A PREFERRED EMBODIMENT

The term "about" is used herein to mean approximately, roughly, around, or in the region of. When the term "about"

is used in conjunction with a numerical range, it modifies that range by extending the boundaries above and below the numerical values set forth. In general, the term "about" is used herein to modify a numerical value above and below the stated value by a variance of 20 percent up or down (higher or lower).

FIG. 1 is a conventional setting of a beverage fulfilment center at a self-serve restaurant, depicting a condition where beverages may be spilled and beverage containers or lids are strewn about and wasted. A typical workflow at such a center involves a user choosing a cup 20 of a particular size. Then the user chooses a beverage and places the cup at a station to receive the beverage. The user then locates a spot in front of a tray where an assortment of condiments are disposed in order to regroup. Magazines 24 of lids are exposed, leaving them at the mercy of dust, germs, and other people's hands. Further, the countertop space can be limited. An uncluttered countertop is essential for the final preparation of beverage. Often times, patrons pick up more lids 22 than required, creating wastes and clutter. If a lid 22 is not properly made around the lid of the cup, it can lead to spills, stains and burns.

Figure 2:
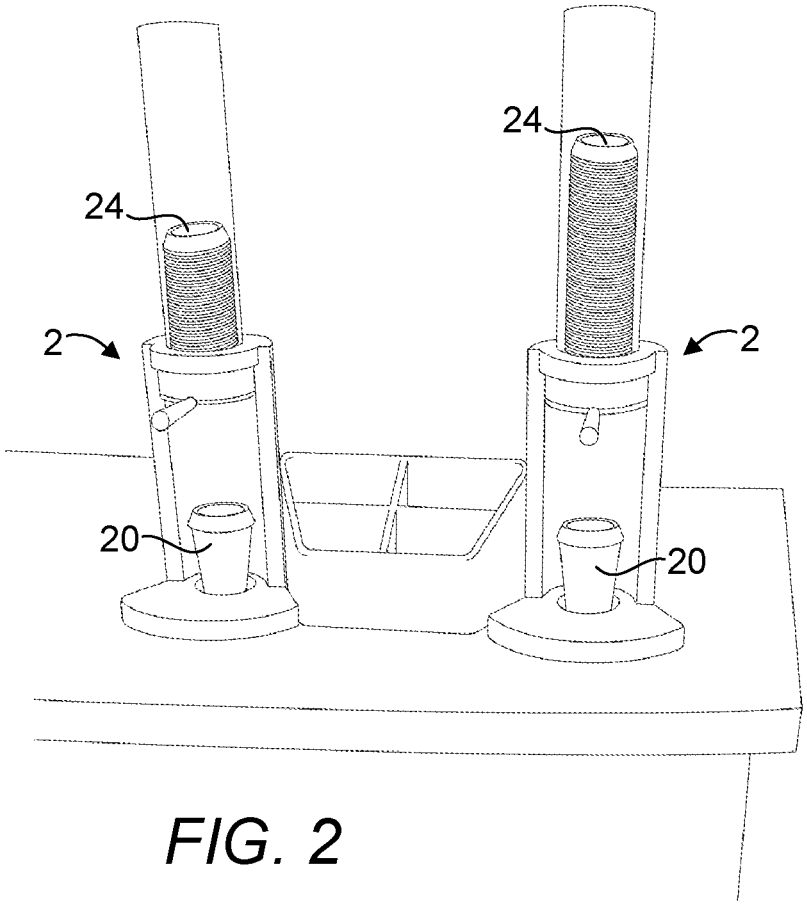
FIG. 2 is a present setting of a beverage fulfilment center at a self-serve restaurant, depicting the use of two disposable beverage lid storage and application devices at a self-serve restaurant.

FIG. 2 is a present setting of a beverage fulfilment center at a self-serve restaurant, depicting the use of two disposable beverage lid storage and application devices at a self-serve restaurant. Magazines 24 of lids are kept safe and clean within the housing of the present device. A lid application device is provided to create a nearly perfect seal around the mouth of a cup, preventing spills and speeding up the process of seating a lid on a cup. A designated station as one shown herein improves an establishment's image and cuts down on clutter. Lids are applied one at a time to ensure that waste is kept to a minimum. The ensuing figures disclose a disposable beverage lid storage and application device capable of aiding a user in consistently seating a lid on a cup. The user first fills a cup with a beverage, e.g., soda, water, hot water mixed with hot cocoa or coffee products, hot cocoa, coffee, solid food products, etc., prior to arriving at the device. Alternatively, the cup may be filled with a content while being seated at the device, e.g., by pouring the content directly into the cup while it is seated in the present device. FIGS. 3-7 depict the outer appearance of the present device and its various components at a superficial level. FIGS. 8-30 delves into the details of the various components of the device.

Figure 3:
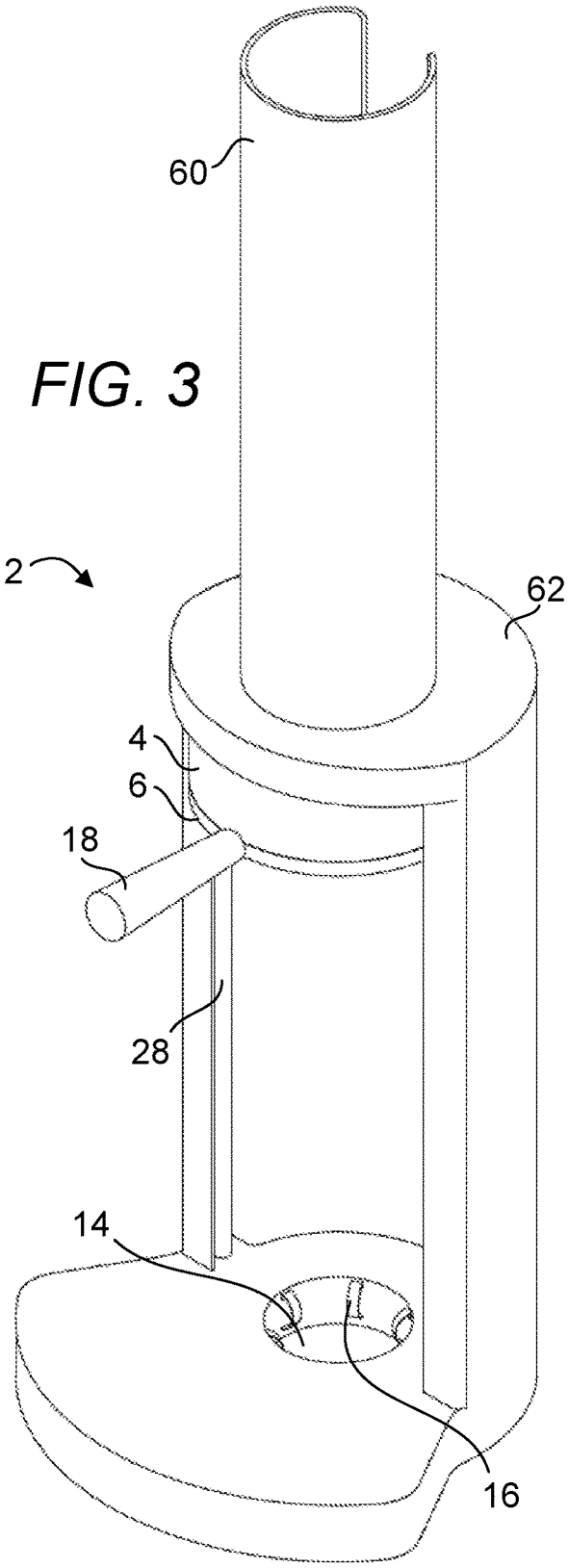
FIG. 3 is a top front perspective view of a disposable beverage lid storage and application device in its at-rest condition.
Figure 4:
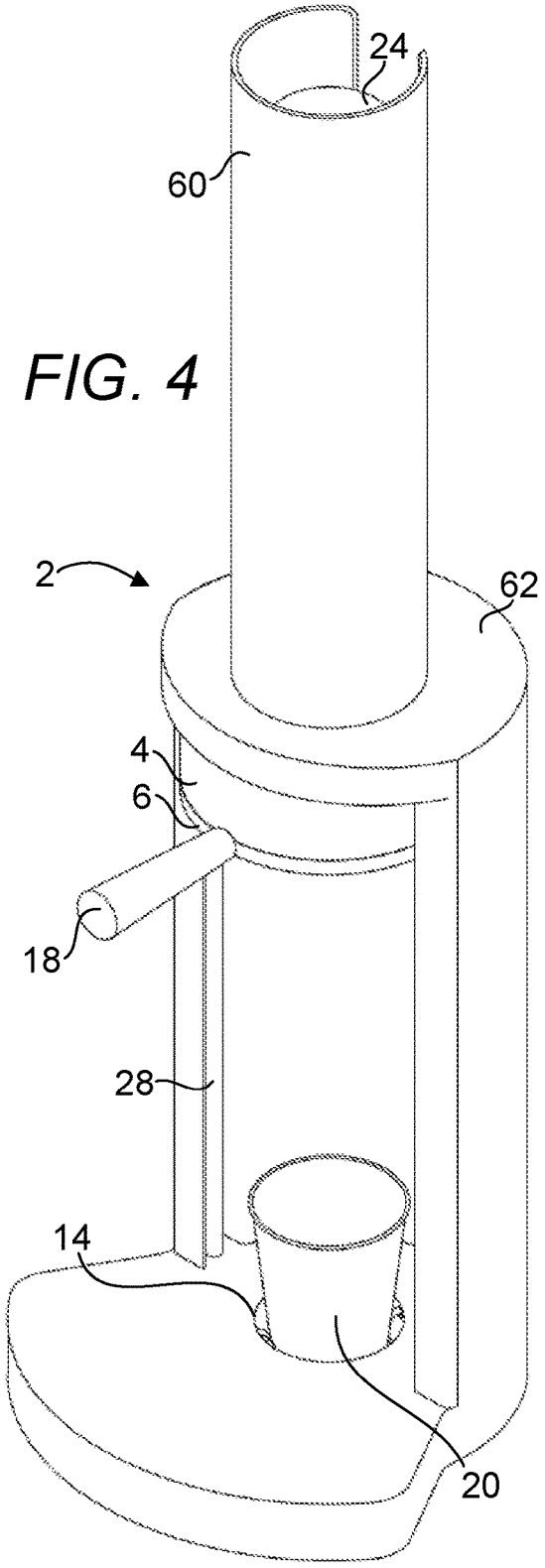
FIG. 4 is a top front perspective view of a disposable beverage lid storage and application device, depicting a press assembly of the device being coupled to a dispense assembly of the device in preparation for receiving a lid, transporting the lid and pressing it onto a beverage cup.

FIG. 3 is a top front perspective view of a disposable beverage lid storage and application device in its at-rest condition. The device is generally a housing 62 or structure to which a number of assemblies are attached. A magazine of lids is fed within a magazine shield 60 before arriving at dispense assembly 4 which receives the magazine of lids and dispenses it to the press assembly 6 which can be moved along guide 28 before a lid received in the press assembly can be seated over the mouth of a cup disposed within a cup holder 14 at a first position at the bottom of the device. The magazine shield 60 prevents an unauthorized person to tamper with the lids disposed therein. A plurality of retainer springs 16 are disposed about the cup holder 14 for snugly receiving a cup and centering the cup while it is seated in the holder 14 in anticipation of the application of a lid atop the cup. FIG. 4 is a top front perspective view of a disposable beverage lid storage and application device, depicting a press assembly 6 of the device being coupled to a dispense assembly 4 of the device in preparation for receiving a lid, transporting the lid and pressing it onto a beverage cup 20. Here, a cup 20 is shown seated in the cup holder 14, ready to receive a lid that will be loaded in the press assembly 6 once the press assembly 6 starts being pulled down at the handle 18 onto the cup 20.

Figure 5:
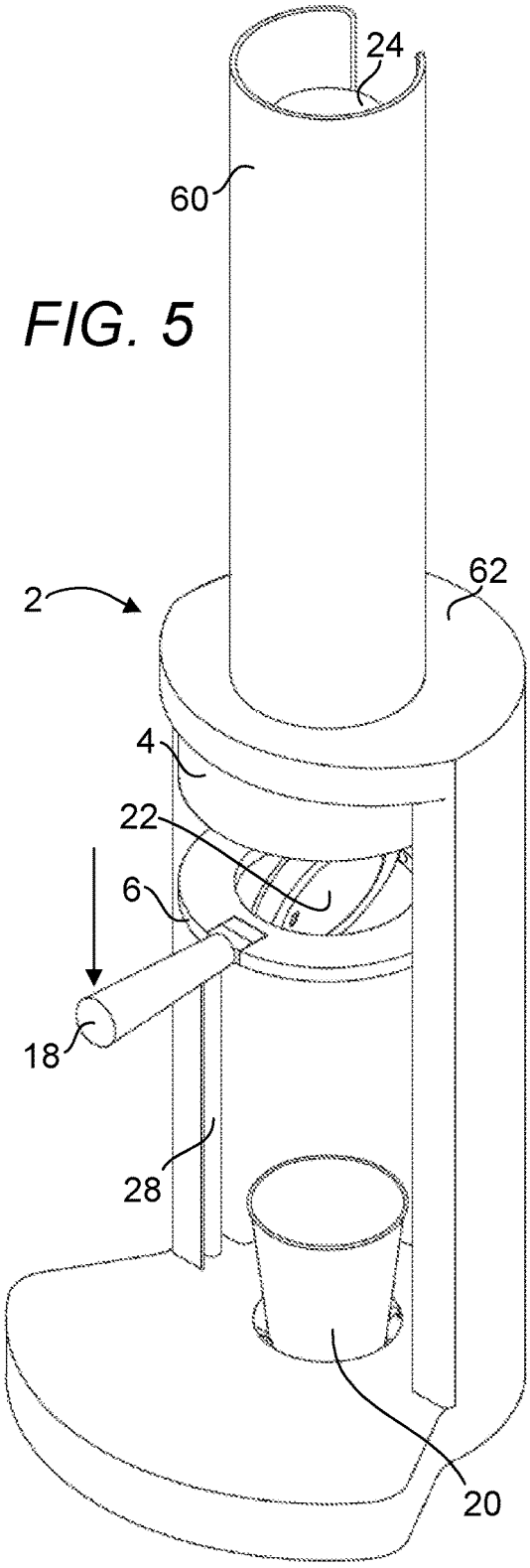
FIG. 5 is a top front perspective view of a disposable beverage lid storage and application device, depicting a press assembly having grasped a dispensed lid, starts to be transported downwardly while the lid is being rotated in preparation for being pressed or seated onto a beverage cup.

FIG. 5 is a top front perspective view of a disposable beverage lid storage and application device, depicting a press assembly having grasped a dispensed lid 22, starts to be transported downwardly while the lid 22 is being rotated in preparation for being pressed or seated onto a beverage cup 20. Rotation of the dispensed lid 22 is necessary as the magazine is loaded with the lids disposed in an upside down fashion.

Figure 6:
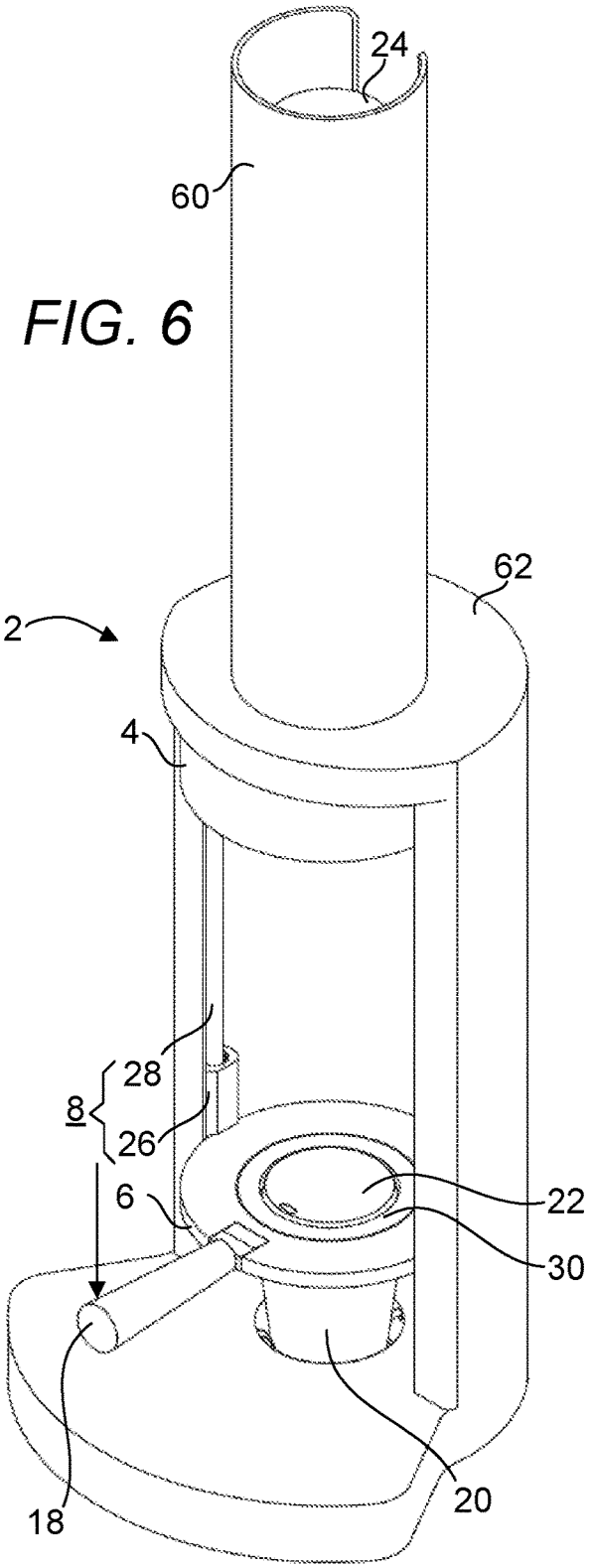
FIG. 6 is a top front perspective view of a disposable beverage lid storage and application device, depicting a dispensed lid, having been transported to the beverage cup from the dispense assembly and is being pressed onto a beverage cup.
Figure 7:
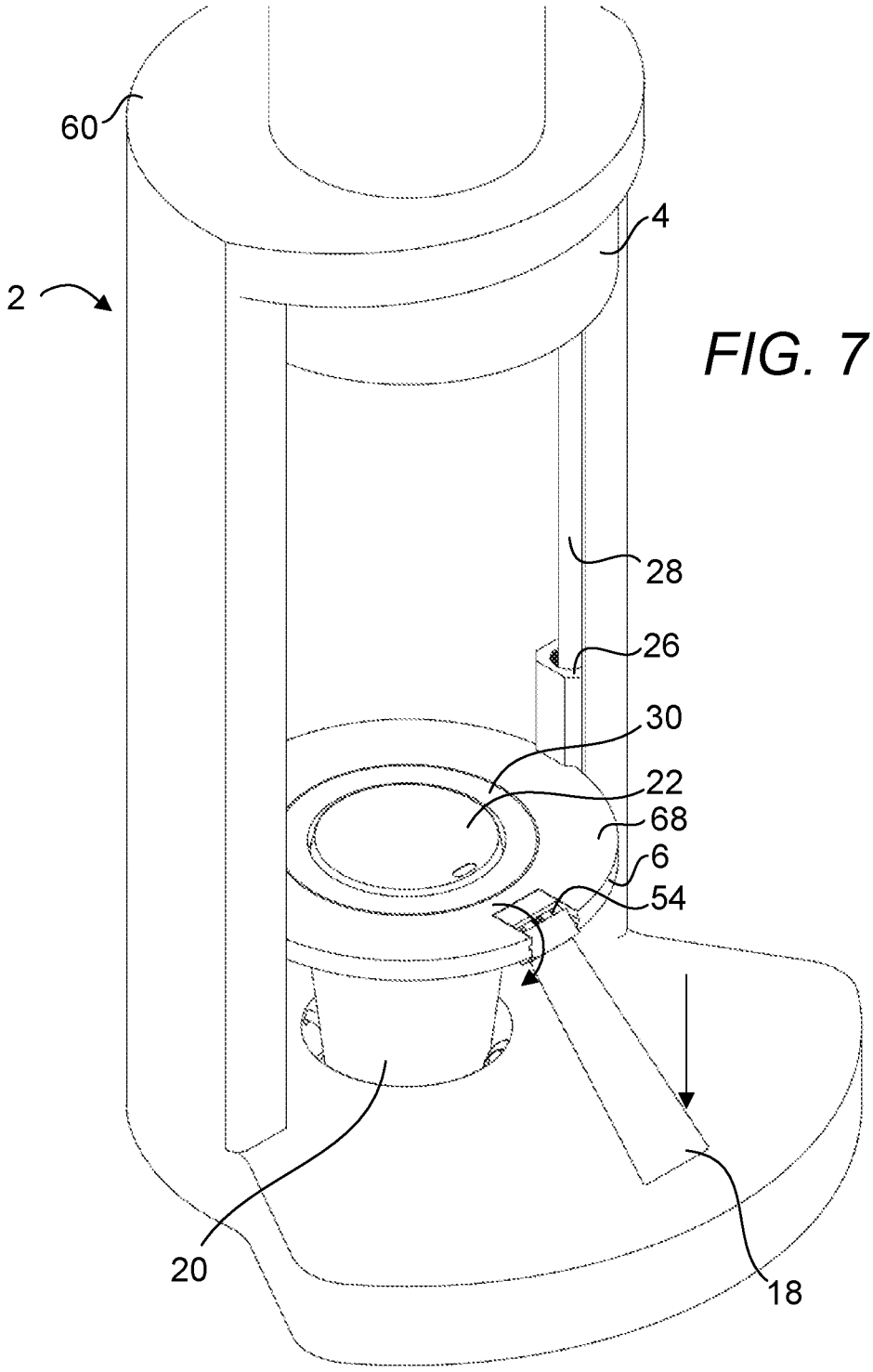
FIG. 7 is a top front perspective view of a disposable beverage lid storage and application device, depicting a lid having been pressed onto a beverage cup and a force limiter having been activated to avoid excessive force applied to the beverage cup.

FIG. 6 is a top front perspective view of a disposable beverage lid storage and application device, depicting a dispensed lid 22, having been transported to the cup 20 from the dispense assembly 4 by a transport assembly 8 and is being pressed onto a cup 20. Note that only one bushing 26 is visible in FIG. 5. Although two guide-bushing pairs are used, a single guide-bushing pair may be sufficient as long as the act of seating a lid on a cup involves only grasping a handle and pulling it downwardly in a linear fashion and that the one pair is sufficiently stiff to enable smooth operation of the device 2. FIG. 7 is a top front perspective view of a disposable beverage lid storage and application device, depicting a lid having been pressed onto a beverage cup and a force limiter, i.e., a resilient member 54, having been activated to avoid excessive force getting applied to the cup 20.

In summary, the present device includes a dispense assembly, a transport assembly, a rotator assembly, a press assembly that is connected to the rotator assembly and a force limiter assembly. In use, as the handle 18 is pulled away from its at-rest position towards a cup to be capped with a force, e.g., applied by hand or manually, a released bottommost lid of the magazine of lids, is received in the press assembly. The present device is configured for a magazine of lids that are loaded upside-down. The released bottommost lid is rotated by the rotator assembly while being transported by the transport assembly before arriving at the first position such that the released bottommost lid is securable to the beverage container by the press assembly. FIG. 5 depicts a device with a rotator assembly where the lid 22 is rotated to its eventual orientation of right side up as the handle 18 continues to be moved downwardly.

Figure 8:
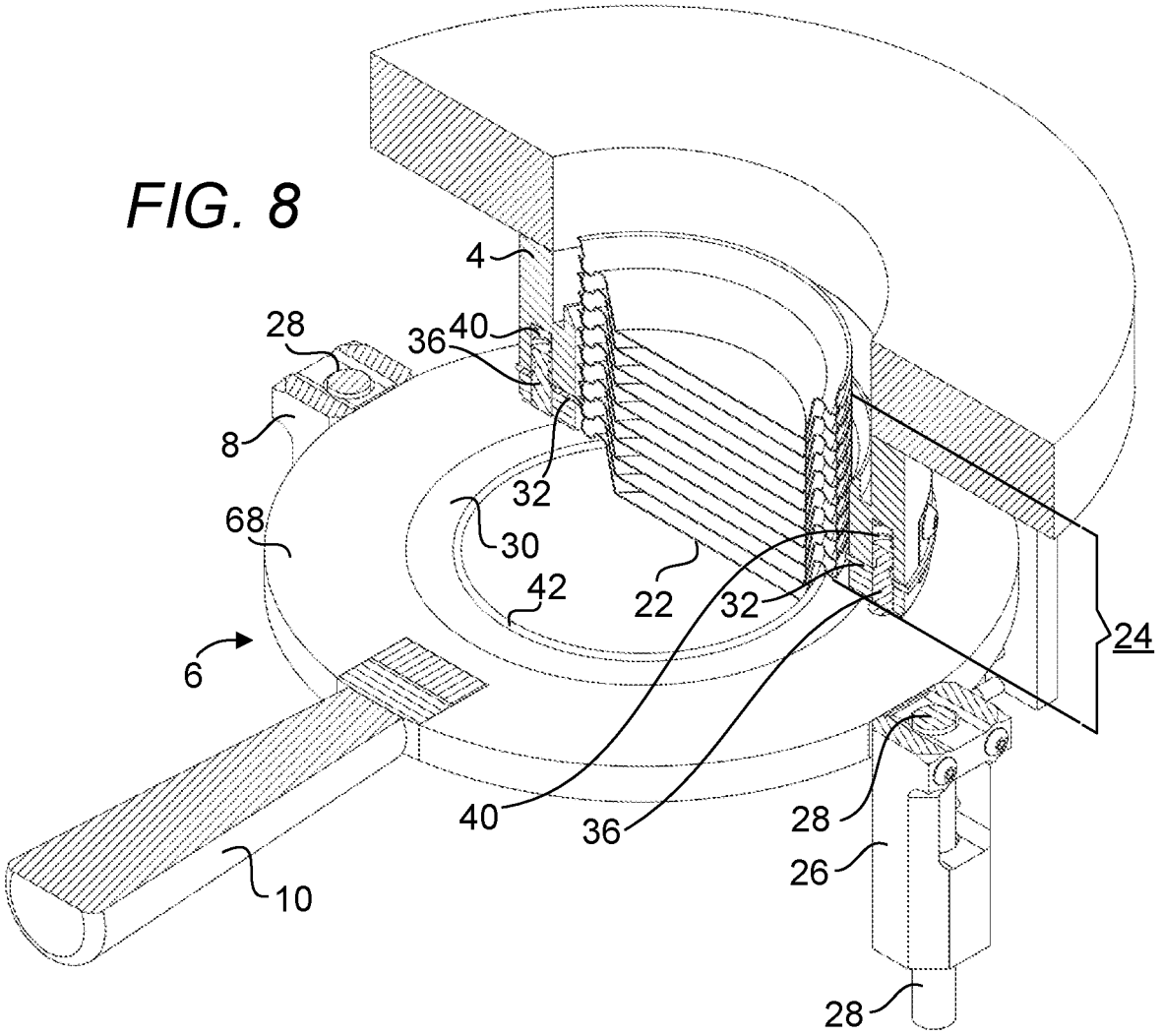
FIG. 8 is a top front partial sectional perspective sectional view of the dispense assembly and press assembly of a disposable beverage lid storage and application device.
Figure 9:
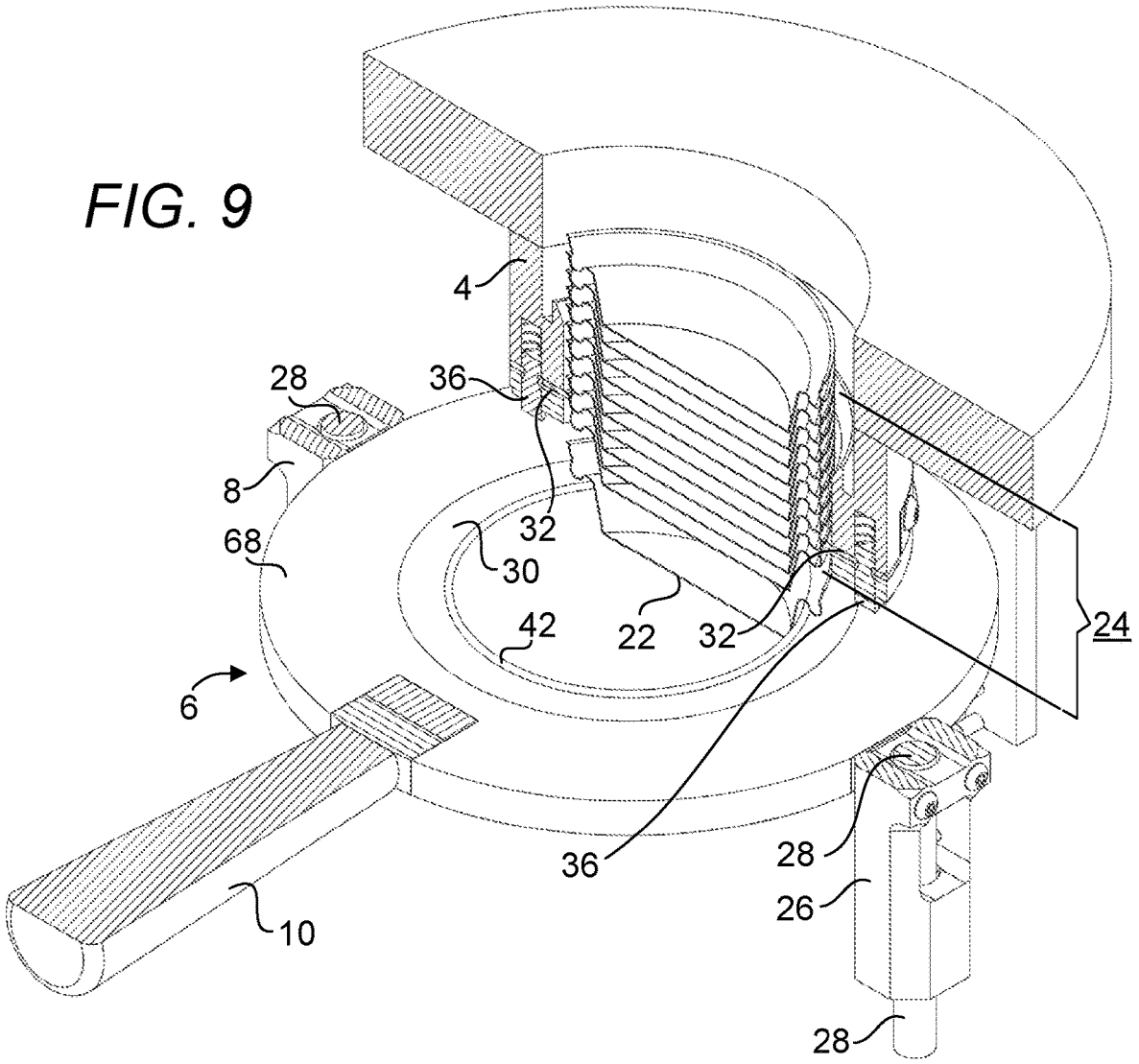
FIG. 9 is a top front partial sectional perspective sectional view of the dispense assembly and press assembly of a disposable beverage lid storage and application device, depicting the press assembly being lowered to separate the bottommost lid from the magazine of lids.
Figure 10:
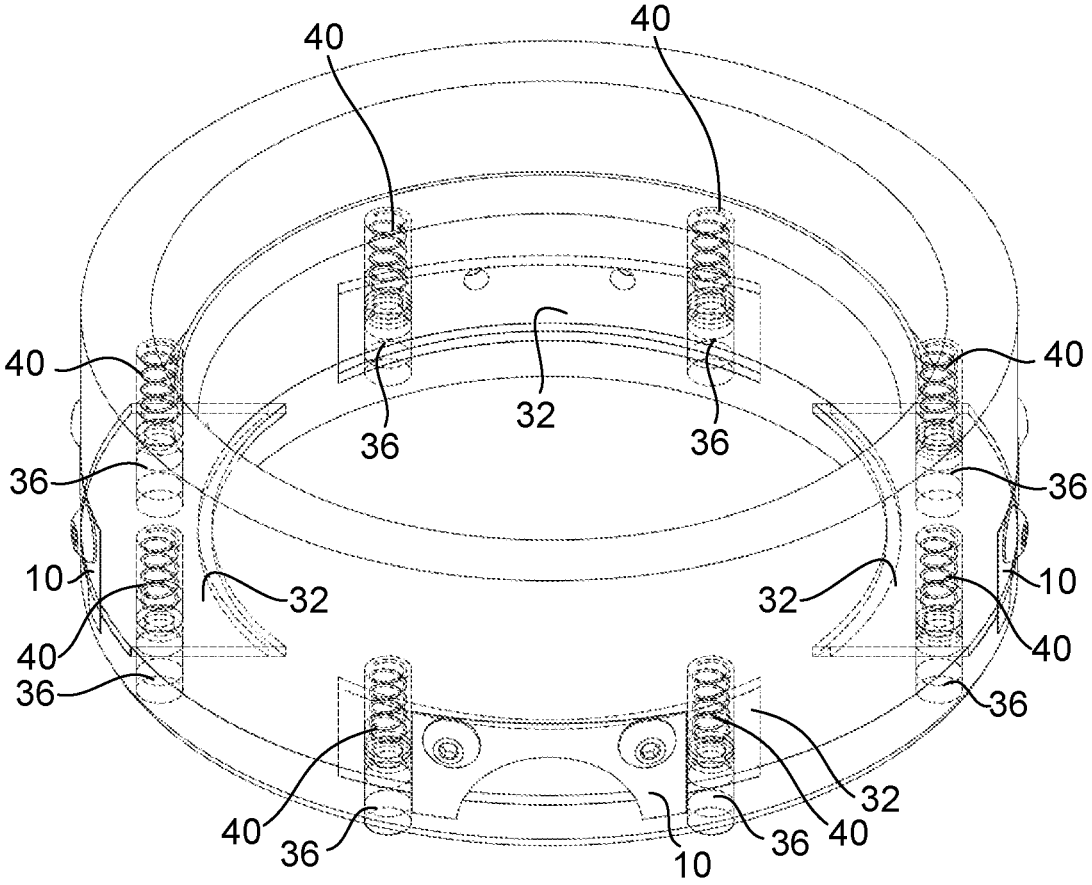
FIG. 10 is a transparent view of the dispense assembly of a disposable beverage lid storage and application device.

FIG. 8 is a top front partial perspective sectional view of the dispense assembly and press assembly of a disposable beverage lid storage and application device. A magazine 24 of lids is shown loaded in the dispense assembly 4 and supported essentially by the press assembly as the magazine support segments 32 are disposed in their retracted position. FIG. 9 is a top front partial perspective sectional view of the dispense assembly and press assembly of a disposable beverage lid storage and application device, depicting the press assembly 6 being lowered to separate the bottommost lid 22 from the rest of the lids of the magazine 24. FIG. 10 is a transparent view of the dispense assembly of a disposable beverage lid storage and application device. FIGS. 11-18 is a series of figures used for describing the manner in which the dispense assembly functions for a dispense assembly configured to accept a magazine of upside down or inverted lids. FIGS. 11-14 depict a series of actions that occur when the press assembly is returned to be coupled with the dispense assembly by the transport assembly. FIGS. 15-18 depict a series of actions that occur when the press assembly is being decoupled from the dispense assembly, e.g., when a lid seating is desired. The dispense assembly 4 is configured for indexing the bottommost lid from a magazine 24 of lids 22 in a first orientation, e.g., upside down.

Figure 11:
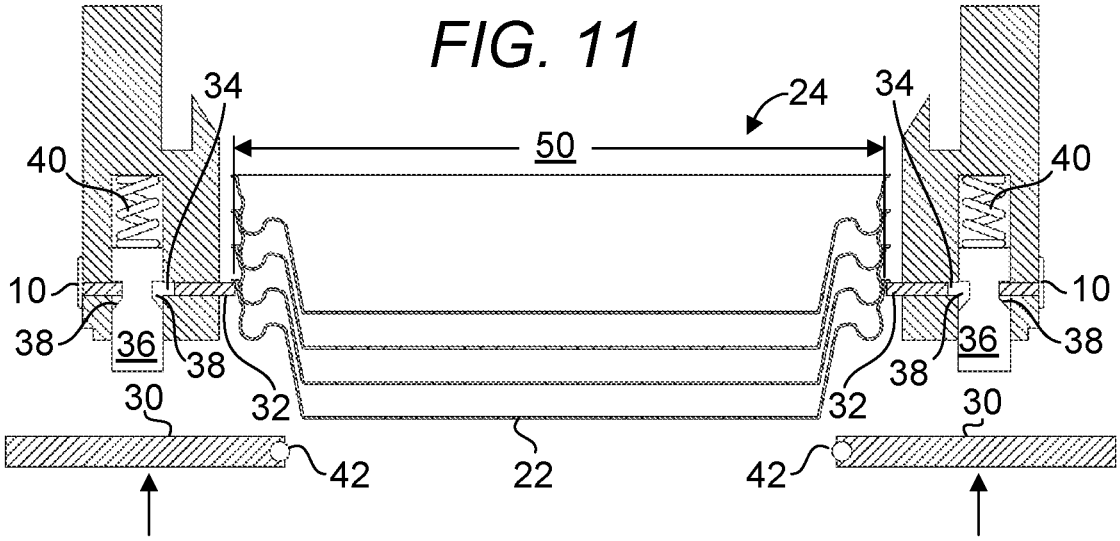
FIG. 11 is a front partial sectional view of the dispense assembly showing a retained magazine of beverage cup lids and a press assembly being returned to be coupled to the dispense assembly to begin a lid seating sequence.

Referring to FIGS. 11-18, the dispense assembly 4 includes at least two magazine support segments 32 biased toward one another forming an opening 50, each of the at least two magazine support segments 32 is coupled to a plunger 36 at a top end of the plunger 36 such that when the plungers 36 are urged upwardly, the opening 50 is widened to release the bottommost lid 22 of the magazine 24 of lids before the opening 50 contracts to support the other lids of the magazine 24 of lids. FIG. 11 is a front partial sectional view of the dispense assembly showing a retained magazine 24 of beverage cup lids and a press assembly being returned, by a return spring (see part 66 of FIGS. 26-29) to be coupled to the dispense assembly to begin a lid seating sequence. It shall be noted that a ring member 42 of the press assembly is approaching a lower portion of the dispense assembly 4. Four sets of plunger (36)-magazine support segment (32) combination are radially disposed about an opening formed of the magazine support segments 32, although two opposingly disposed sets will suffice. Each plunger 36 is confined within an elongated cavity having a width and configured to be slideable vertically within the cavity. When inserted in a slot 34 of a magazine support segment 32, the position of each plunger 36 within the cavity dictates the size of the opening 50 formed of the magazine support segments 32 as a cutout 38 along the length of the plunger 36 enables a lateral shift in the magazine support segment 32. The plunger 36 has a width that is just under the width of the cavity allowing it to slide well within the cavity and a cutout 38. If a cylindrically-shaped cutout plunger 36 is used, the cutout 38 can be formed by routing out a portion of the plunger 36 while axially rotating the plunger 36. The plunger 36 can also be from of a rod of another cross-sectional shape as long as the cutout conforms to a particular profile. It shall be noted that the cutout 38 on the side of the opening is unnecessary although manufacturing techniques used in forming a cylindrically-shaped plunger 36 necessarily creates a cutout on the side of the opening. The cutout on the far side of the opening is required. A cutout that functions well is one which allows the plunger 36 to only have a limited range of movement and one which causes the plunger 36 to be retained within the cavity. A cutout that functions well has a surface that is roughly perpendicular to the direction of movement of the plunger 36 at its upper portion or a surface which limits the protrusion of the plunger 36 from the cavity and a surface that gradually approaches the width of the plunger 36 at its lower portion, causing an upward movement of the plunger 36 that drives an enlargement of the opening 50 of the segments 32 and a downward movement of the plunger 36 that drives a decrease in the opening 50 of the segments 32. When the press assembly is absent, spring 40 urges plunger 36 to protrude from the lower portion of the dispense assembly 4. Each segment 32 is normally urged towards the center of the opening by a spring 10.

Figure 12:
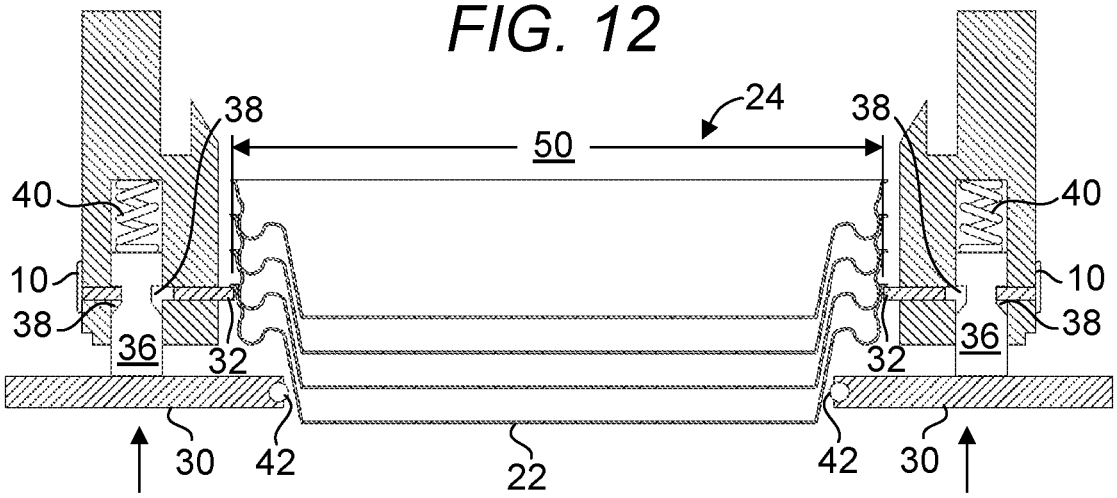
FIG. 12 is a front partial sectional view of the dispense assembly showing the press assembly moving up and coming in contact with the plungers of the dispense assembly, pushing the lid magazine support segments outwardly to commence release of the next beverage cup lid.
Figure 13:
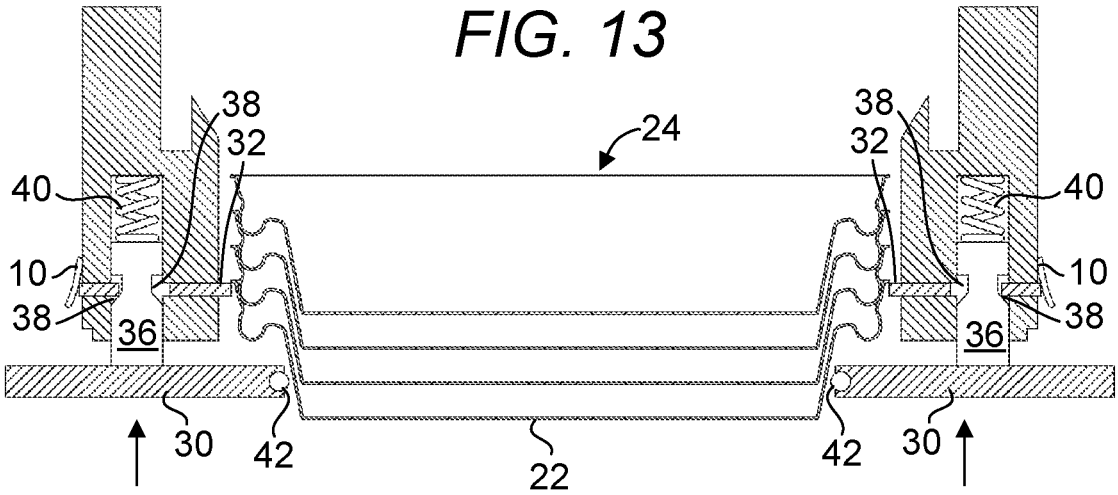
FIG. 13 is a front partial sectional view of the dispense assembly, depicting the press assembly continuing to move up and further elevating the plungers of the dispense assembly, continuing to push the lid magazine support segments outwardly.
Figure 14:
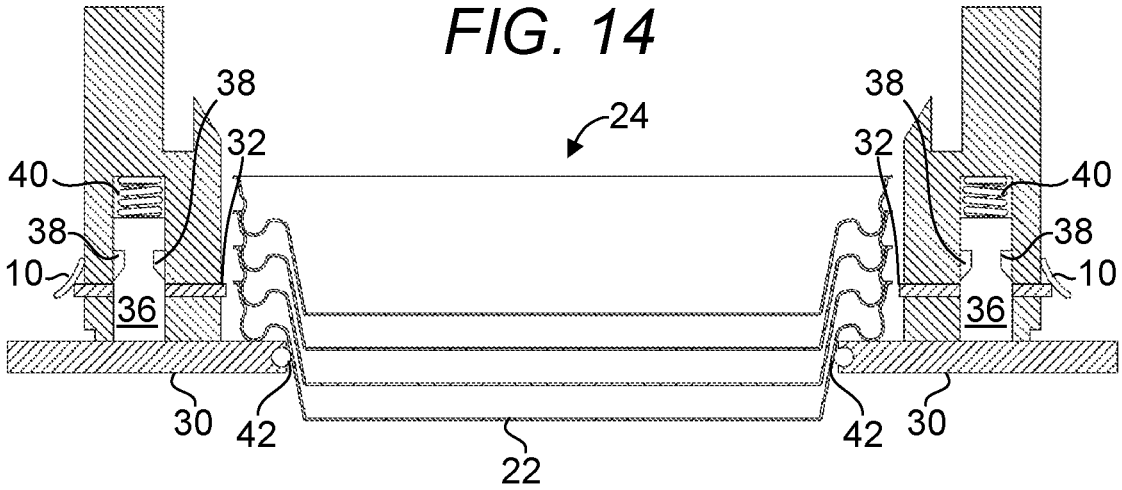
FIG. 14 is a front partial sectional view of the dispense assembly, depicting the release of the magazine of lids as the press assembly has now fully depressed the plungers.
Figure 15:
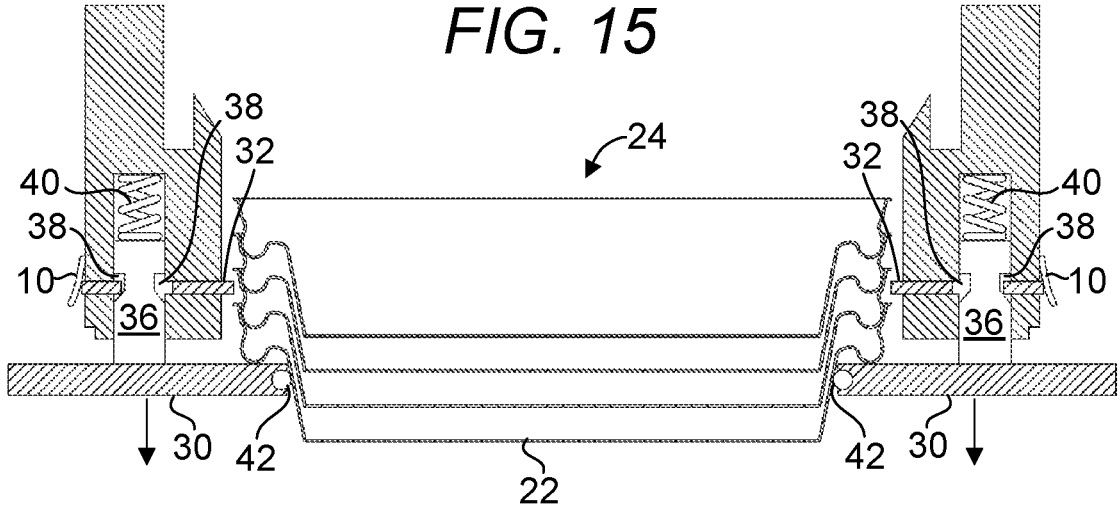
FIG. 15 is a front partial sectional view of the dispense assembly, depicting the result of moving the press assembly away from the dispense assembly after they have been previously coupled.
Figure 16:
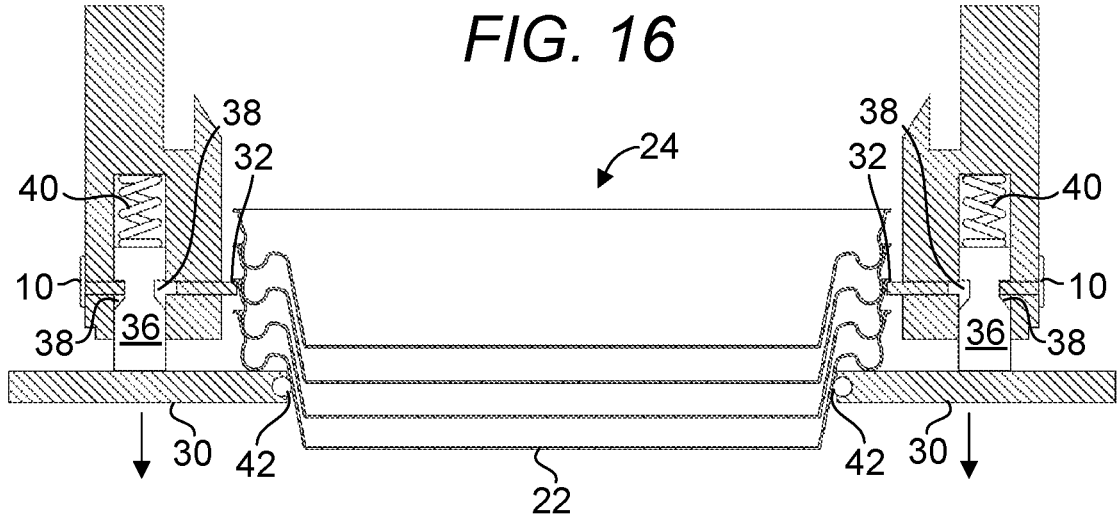
FIG. 16 is a front partial sectional view of the dispense assembly, depicting the press assembly continuing to be moved down and further allowing the plungers of the dispense assembly to drop, continuing to allow the lid magazine support segments to be biased inwardly to secure the magazine of lids with the exception of the bottommost lid.
Figure 17:
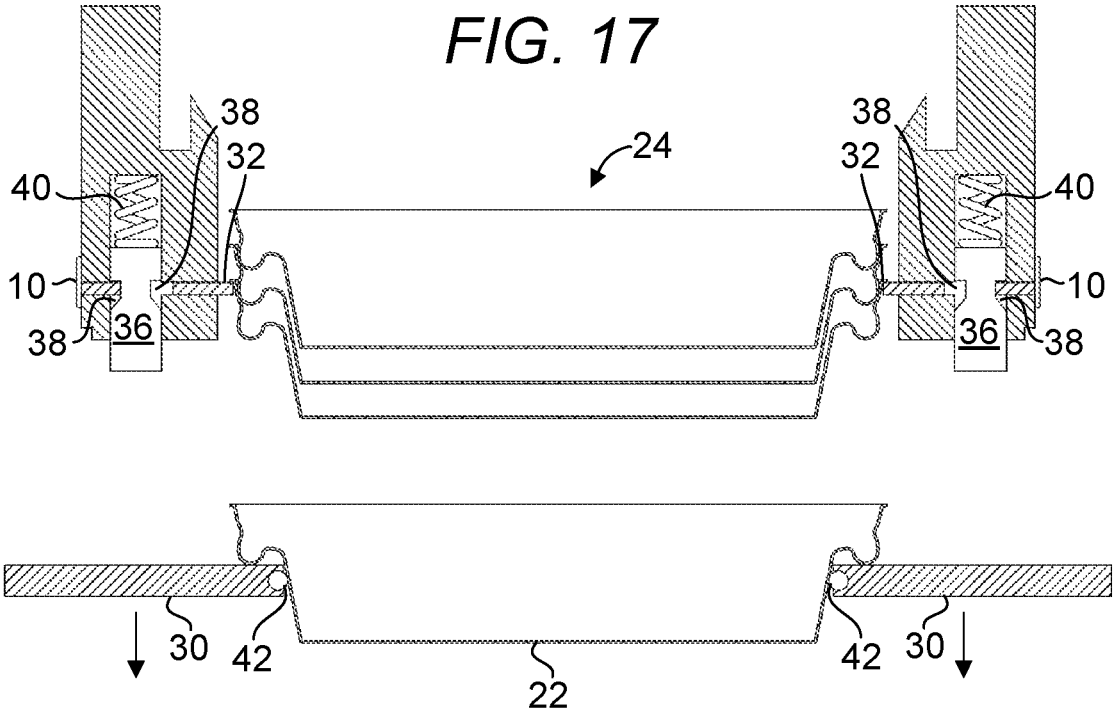
FIG. 17 is a front partial sectional view of the dispense assembly, depicting the press assembly continuing to be moved down and clears the plungers of the dispense assembly and the bottommost lid is now separated from the magazine of lids.
Figure 18:
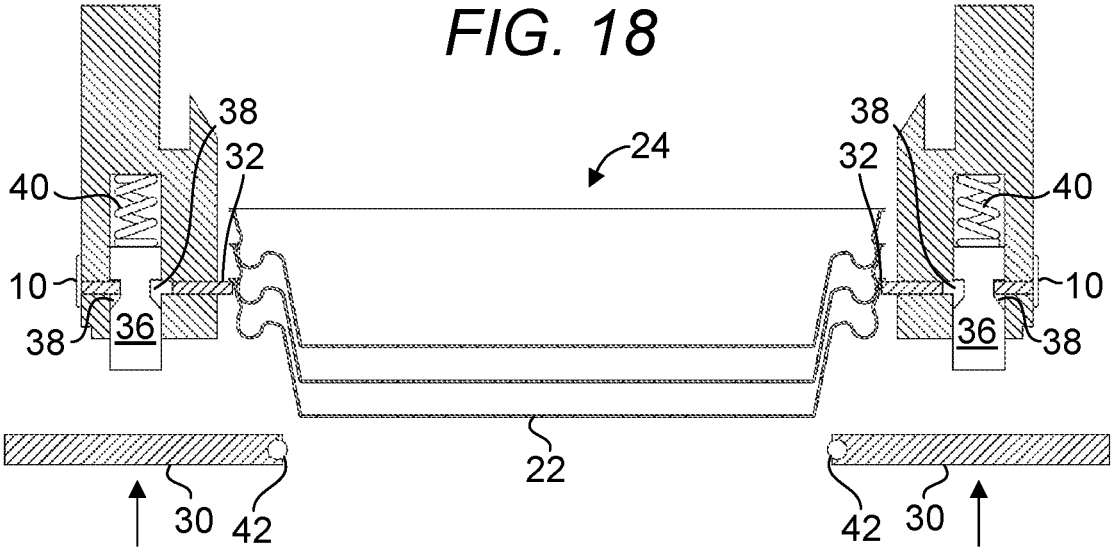
FIG. 18 is a front partial sectional view of the dispense assembly showing a retained magazine of beverage cup lids and the press assembly being returned to be coupled to the dispense assembly to be ready for the next lid seating sequence.

FIG. 12 depicts the press assembly moving up and coming in contact with the plunger 36 of the dispense assembly, pushing the lid magazine support segments 32 outwardly to commence release of the bottommost beverage cup lid from the magazine 24. FIG. 13 depicts the press assembly continuing to move up and further elevating the plungers 36 of the dispense assembly, continuing to push the lid magazine support segments 32 outwardly. FIG. 14 depicts the release of the magazine 24 of lids as the press assembly has now fully depressed the plungers 36. FIG. 15 depicts the result of moving the press assembly away from the dispense assembly after they have been previously coupled. FIG. 16 depicts the press assembly continues to be moved down and further allowing the plungers 36 of the dispense assembly to drop, continuing to allow the lid magazine support segments to be biased inwardly to secure the magazine of lids with the exception of the bottommost lid. FIG. 17 depicts the press assembly continues to be moved down and clears the plungers 36 of the dispense assembly and the bottommost lid 22 is now separated from the magazine 24 of lids. FIG. 18 depicts a retained magazine 24 of beverage cup lids and the press assembly being returned to be coupled to the dispense assembly to be ready for the next lid seating sequence. Note that there are now three lids in the magazine 24, i.e., one fewer than the magazine 24 shown in FIG. 16.

Figure 19:
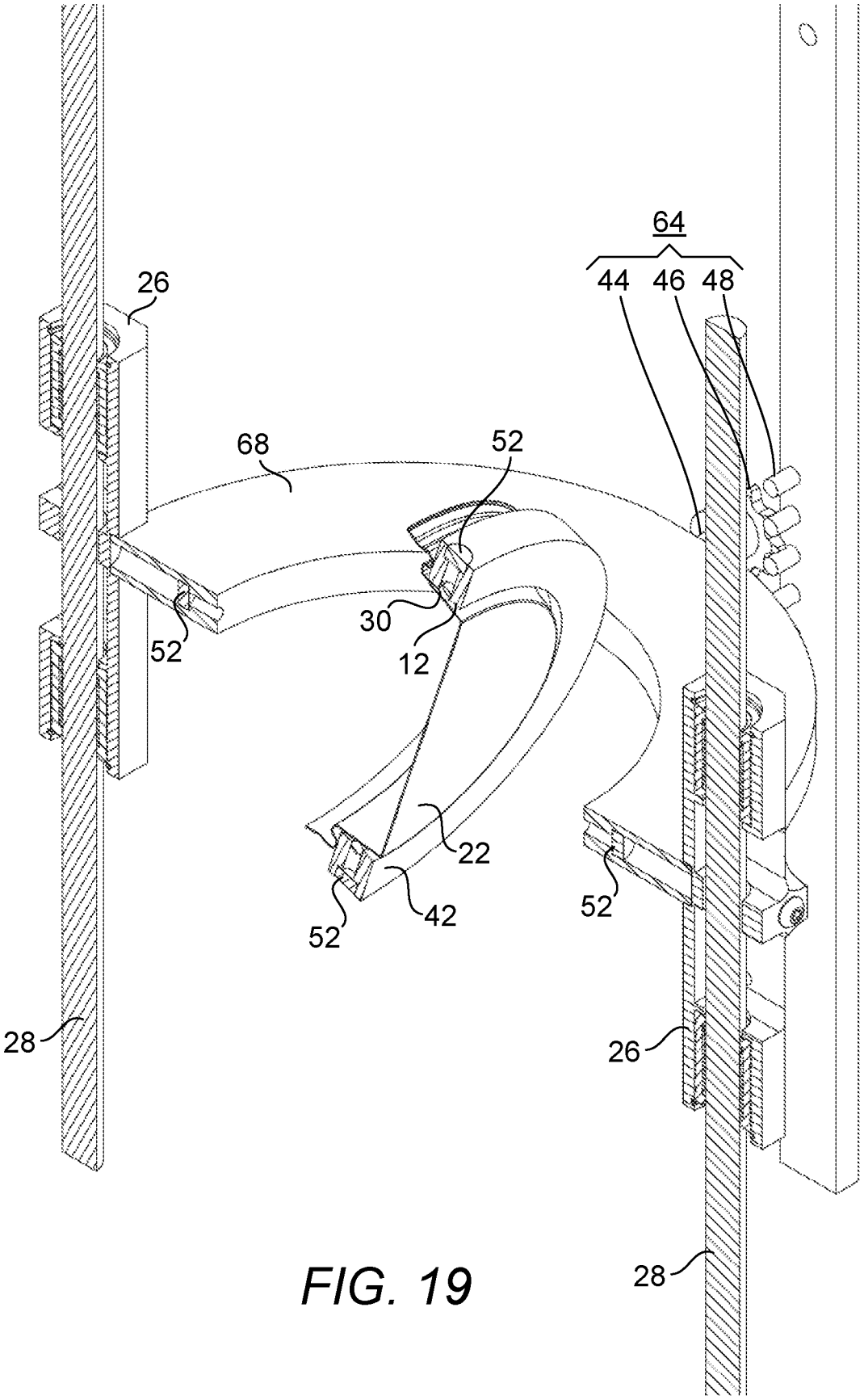
FIG. 19 is a partial front perspective sectional view of a press assembly, depicting the manner in which a dispensed lid is being righted.
Figure 20:
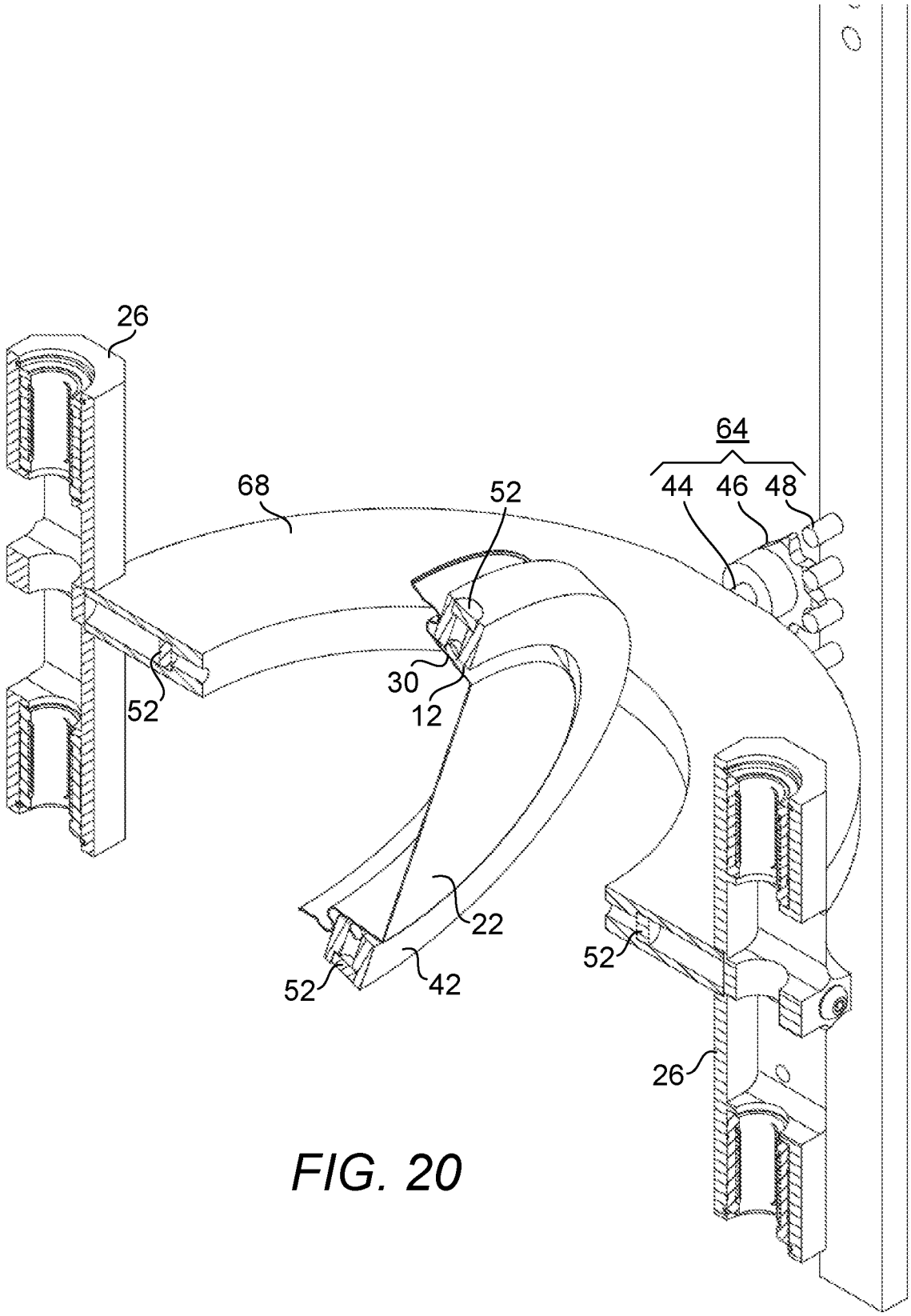
FIG. 20 is a partial front perspective sectional view of a press assembly, depicting the manner in which a dispensed lid is being righted with some transport components removed.
Figure 21:
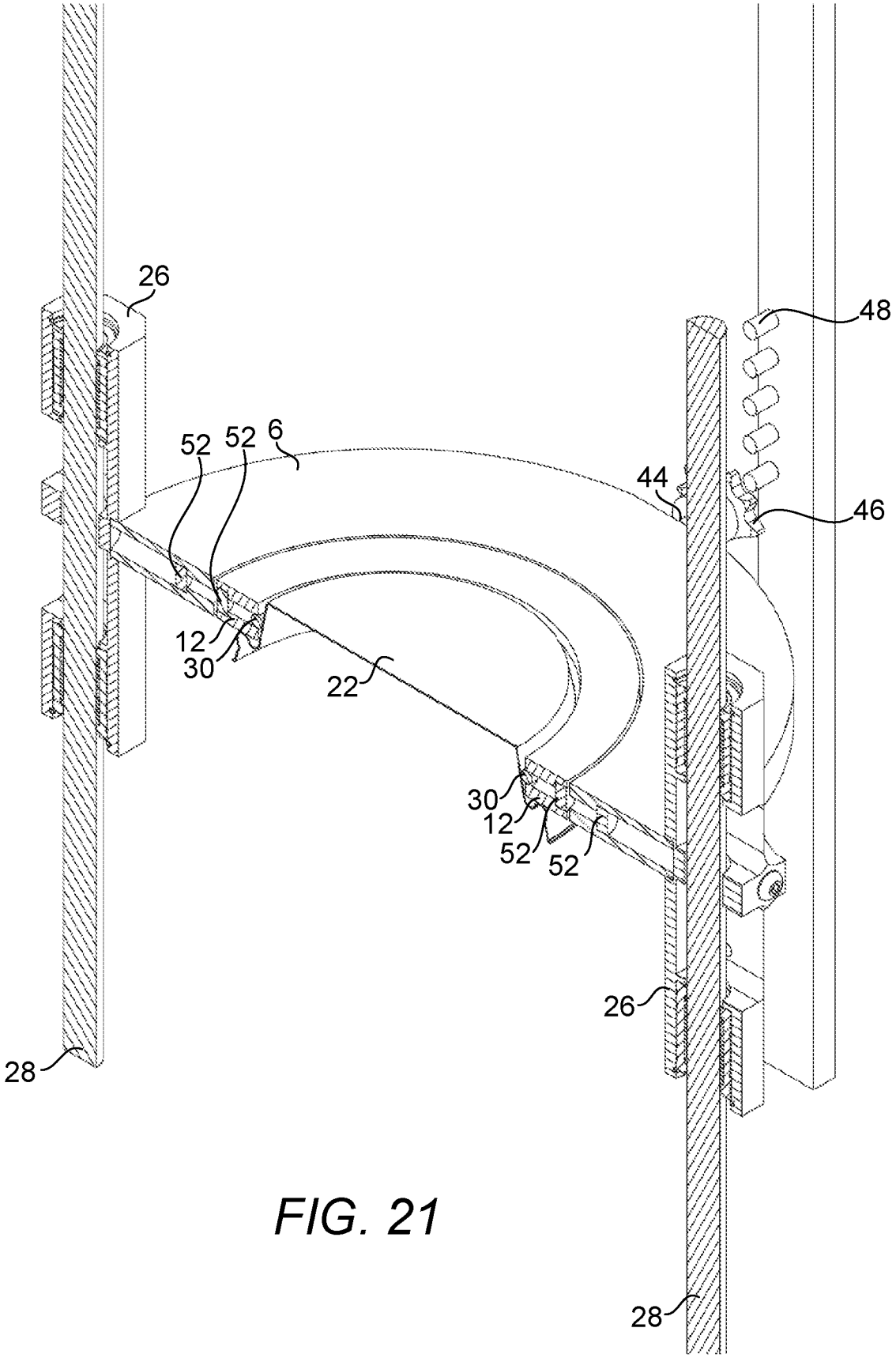
FIG. 21 is a partial front perspective sectional view of a press assembly, depicting a dispensed lid that has been righted.

FIG. 19 is a partial front perspective sectional view of a press assembly, depicting the manner in which a dispensed lid is being righted by a rotator assembly 64. FIG. 20 is a partial front perspective sectional view of a press assembly, depicting the manner in which a dispensed lid is being righted with some transport components removed. FIG. 21 is a partial front perspective sectional view of a press assembly, depicting a dispensed lid that has been righted. Upon leaving the dispense assembly, the transport assembly guides the press assembly to the cup onto which the lid 22 secured in the press assembly will be seated. The press assembly 6 is attached to a pair of bushings 26 disposed about the press assembly 6, each configured to slide along a guide 28. The guide 28 aids in guiding the lid grasping ring 30 to the cup or container at a first position in a first direction and guiding the return of the lid grasping ring 30 to the dispense assembly once seating of the lid secured by the ring 30 has been completed. A return spring (see FIG. 26) attached to the bushing 26, returns the press assembly to a second position in a second direction opposite to the first direction. A magazine 24 of lids is loaded with the lids upside down. As such, upon loading onto the press assembly, the bottommost lid must be righted before being seated to a cup. In this embodiment, the device further includes a rotator assembly. The rotator assembly includes a pair of pins 44 mounted about the press assembly in order to rotate the grasping ring 30, a rack 48 and a pinion 46 connected to a pin 44 on one end. The pinion 46 is configured to be rotatable about the central axis of the pin and a rack rotatably coupled with the rack 48. The rack 48 is part of a bar connecting the dispense assembly and a base. The rotator assembly is configured for rotating the lid grasping ring 30 to a second orientation that is disposed at about 180 degrees with respect to the first orientation. Further disclosed is a mechanism for stabilizing the lid grasping ring 30 upon rotation. A first pair of magnets 52, each magnet disposed in one edge of the lid grasping ring 30 in a plane in which the lid grasping ring 30 is disposed. A second pair of magnets 52 is disposed in the support ring 68, each magnet is disposed in a manner to match a magnet of the first pair of magnets 52 disposed in the lid grasping ring 30. Each magnet of the first pair of magnets is configured to be attracted to a magnet of the second pair of magnets, thereby aligning said first plane with a cup to ease seating of the lid onto the cup.

Figure 22:
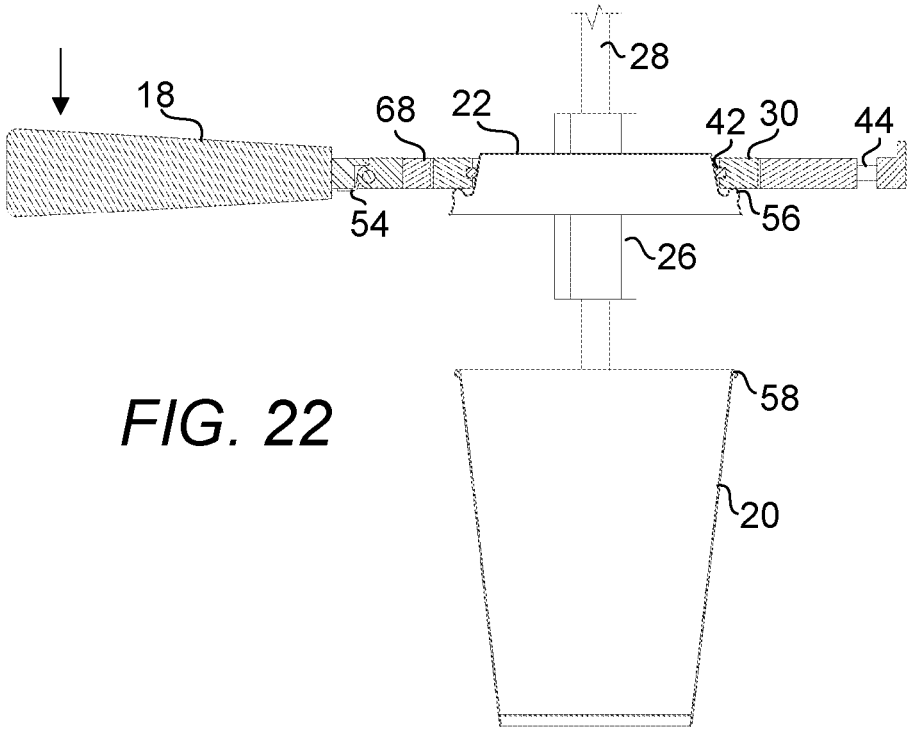
FIG. 22 is a partial side sectional view of a righted lid that is ready to be seated onto a cup.
Figure 23:
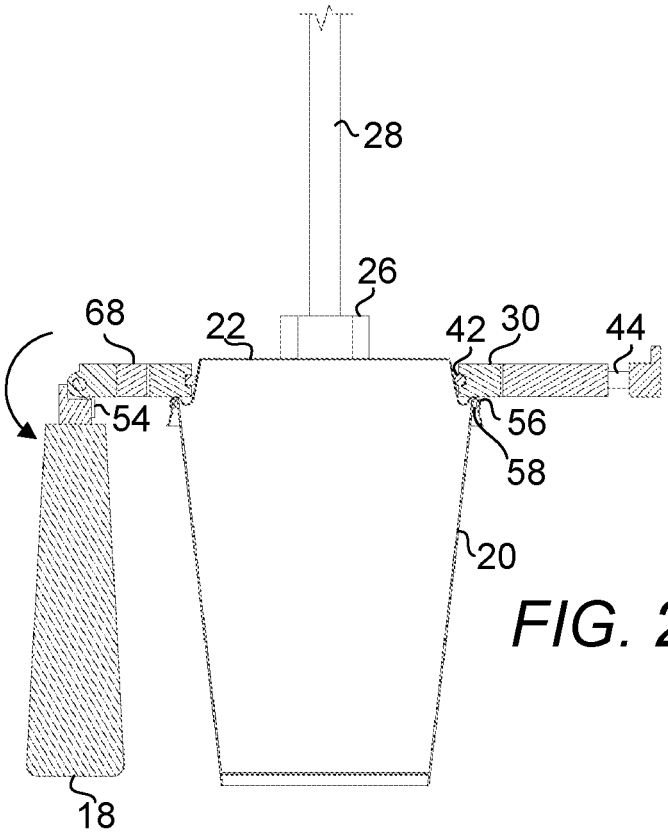
FIG. 23 is a partial side sectional view of a righted lid that has been seated onto a cup.

FIG. 22 is a partial side sectional view of a righted lid that is ready to be seated onto a cup. As the lid 22 continues to be lowered, the sealing rim 56 of the lid 22 eventually comes in contact with the cup lip 58. FIG. 23 is a partial side sectional view of a righted lid that has been seated onto a cup. The handle 18 is pivotably attached to the support ring 68. A force limiter 54 assembly is configured for bridging the handle 18 and the support ring 68. The force limiter includes a resilient member having two ends, a first end of the resilient member is attached to the handle 18 and a second end of the resilient member is attached to the support ring 68. As the lid 22 continues to be lowered further and when the applied downward force exceeds a pre-determined threshold, the handle 18 starts to get rotated, indicating that the lid 22 is now fully seated. As the handle 18 continues to rotate about the force limiter 54, the full extent of the downwardly applied force is avoided at the cup 20, thereby preventing the cup 20 from getting damaged. In one embodiment, the resilient member is a torsion spring. Alternatively, a flexible rod or a coil spring arranged coaxially with the handle may be used in place of the torsion spring.

Figure 24:
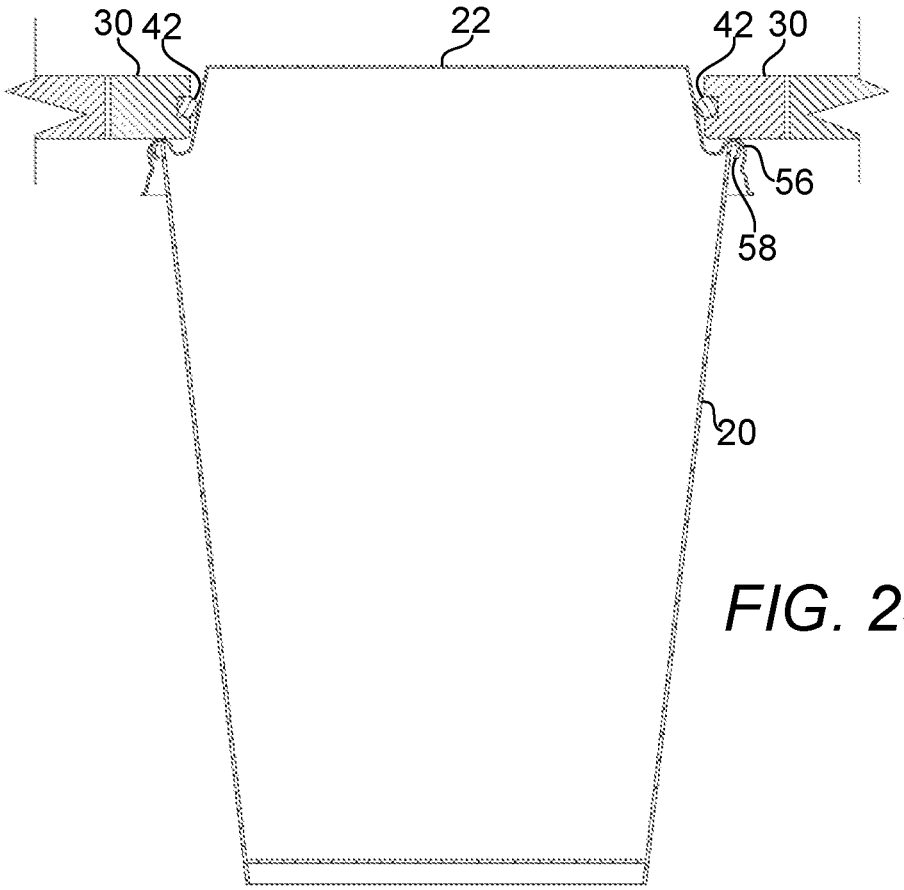
FIG. 24 is a partial side sectional view of one embodiment of a press assembly.
Figure 25:
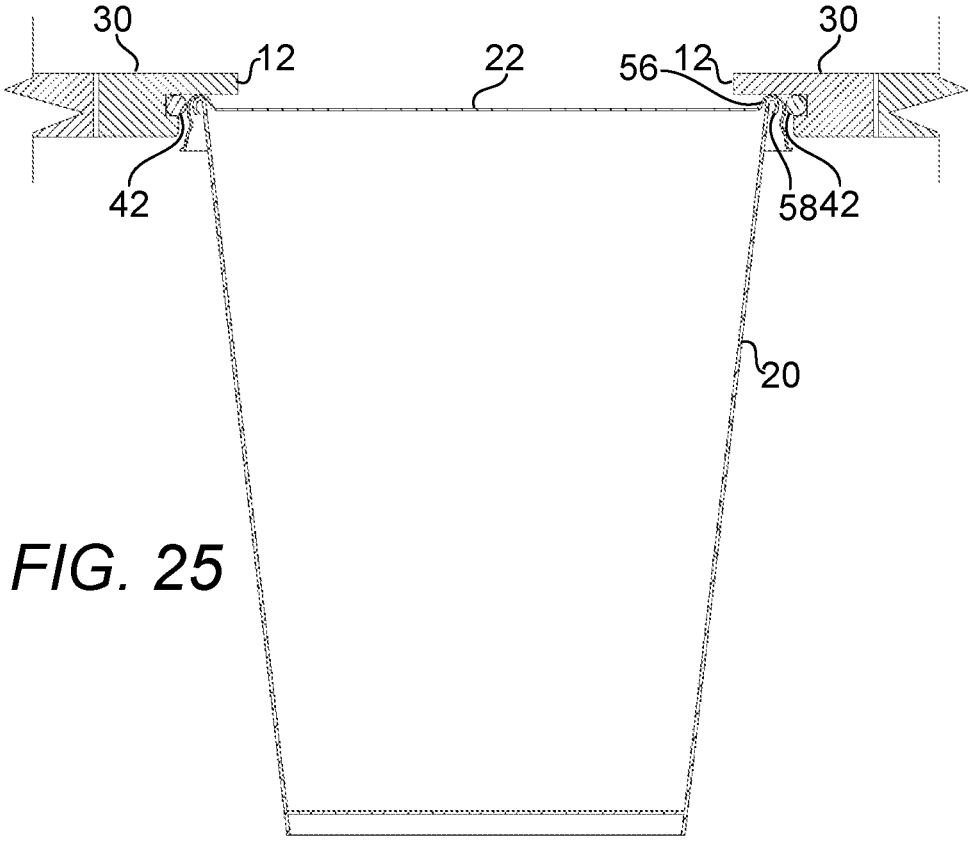
FIG. 25 is a partial side sectional view of another embodiment of a press assembly.

FIG. 24 is a partial side sectional view of one embodiment of a press assembly. FIG. 25 is a partial side sectional view of another embodiment of a press assembly. Note the two different types of lids that can be used with the present device. In FIG. 24, the lid shown is a lid with its center extending above the sealing rim 56. The ring member 42 comes in contact with a portion of the center of the lid 22. In FIG. 25, the lid shown does not have a center which extends above the sealing rim 56. The ring member 42 comes in contact with a portion of the sealing rim 56 itself. A ring member 42 is preferably a resilient material, e.g., rubber and configured to be replaceable due to wear from repeated engagements and disengagements of lids. In one embodiment, the ring member 42 is a continuous structure. In another embodiment, the ring member 42 is a segmented structure. It shall be noted that the press assembly of shown in FIG. 25 further includes a protruding ring 12 disposed in a plane. The protruding ring 12 has an opening of a diameter that is smaller than the diameter of the opening of the ring member 42. The protruding ring 12 is disposed in a plane that is parallel to and at an offset to a plane of the lid grasping ring 30, where the protruding ring 12 comes in contact with a portion of the lid 22 such that the force can be uniformly applied on the lid 22 to secure the lid 22 to the lip 58 of the beverage container 20.

Figure 26:
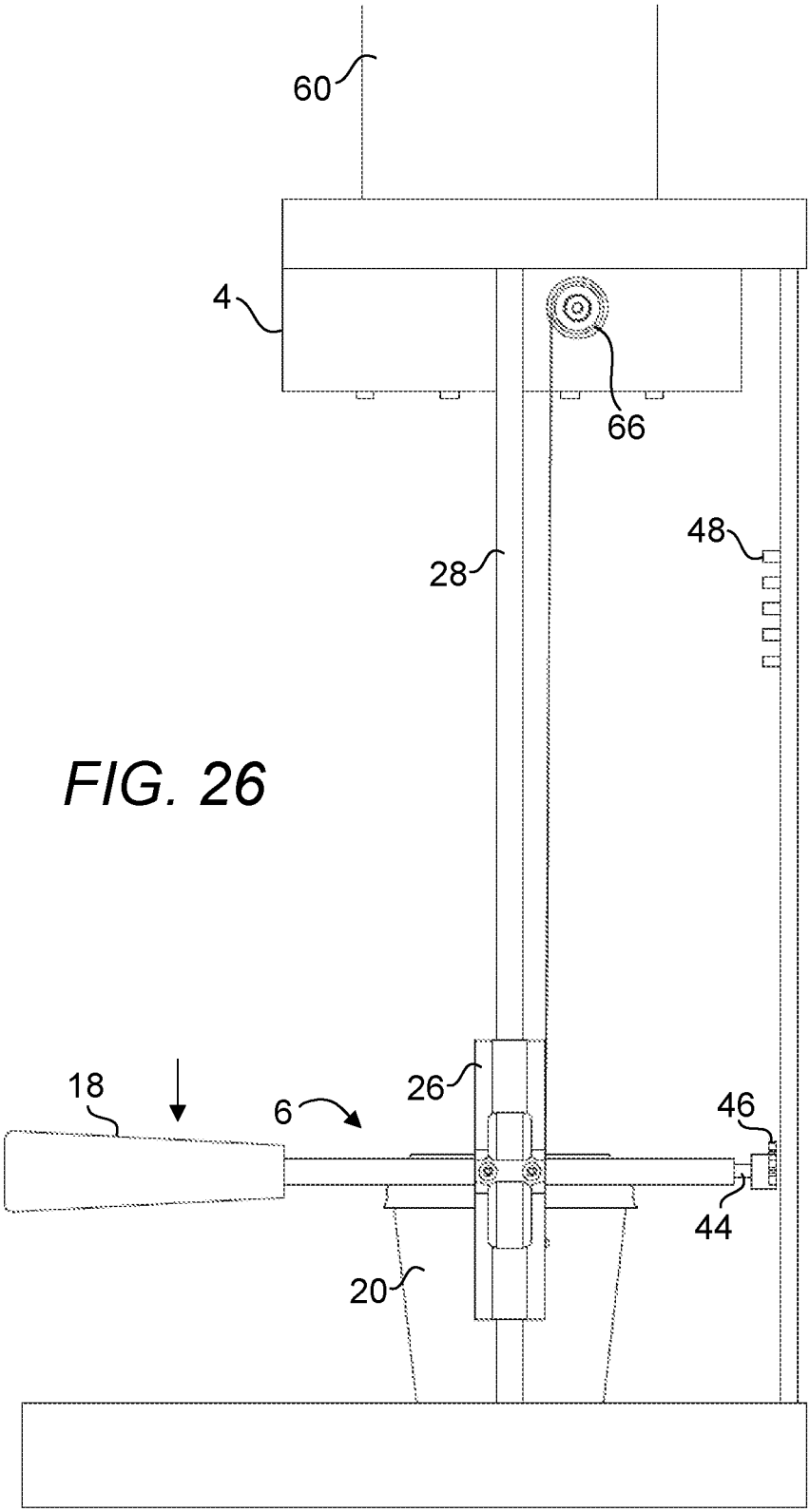
FIG. 26 is a partial side view of one embodiment of a lid application device, depicting a return spring connected to a press assembly that is ready to return the press assembly to be coupled with a dispense assembly.
Figure 27:
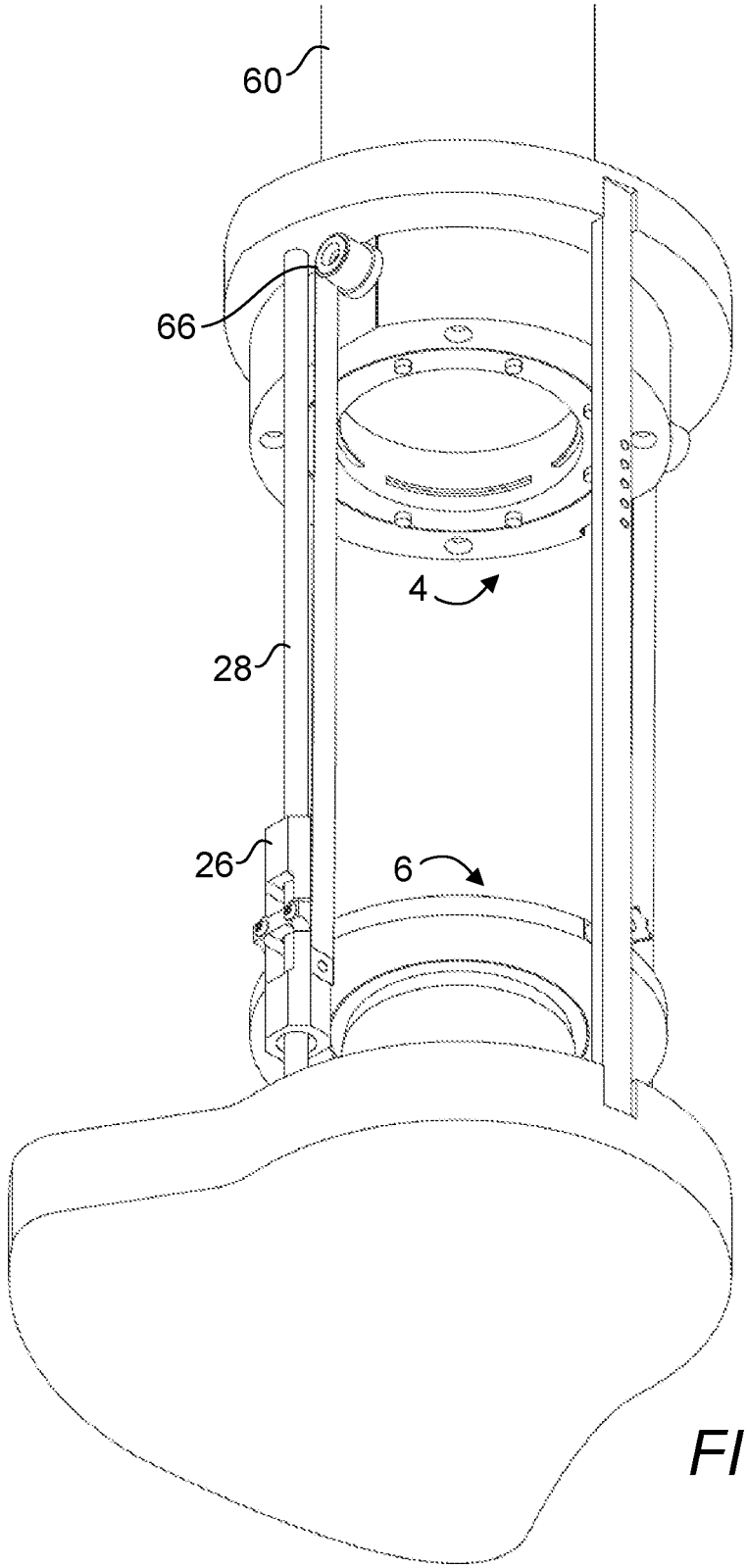
FIG. 27 is a partial bottom rear view of the embodiment shown in FIG. 26.
Figure 28:
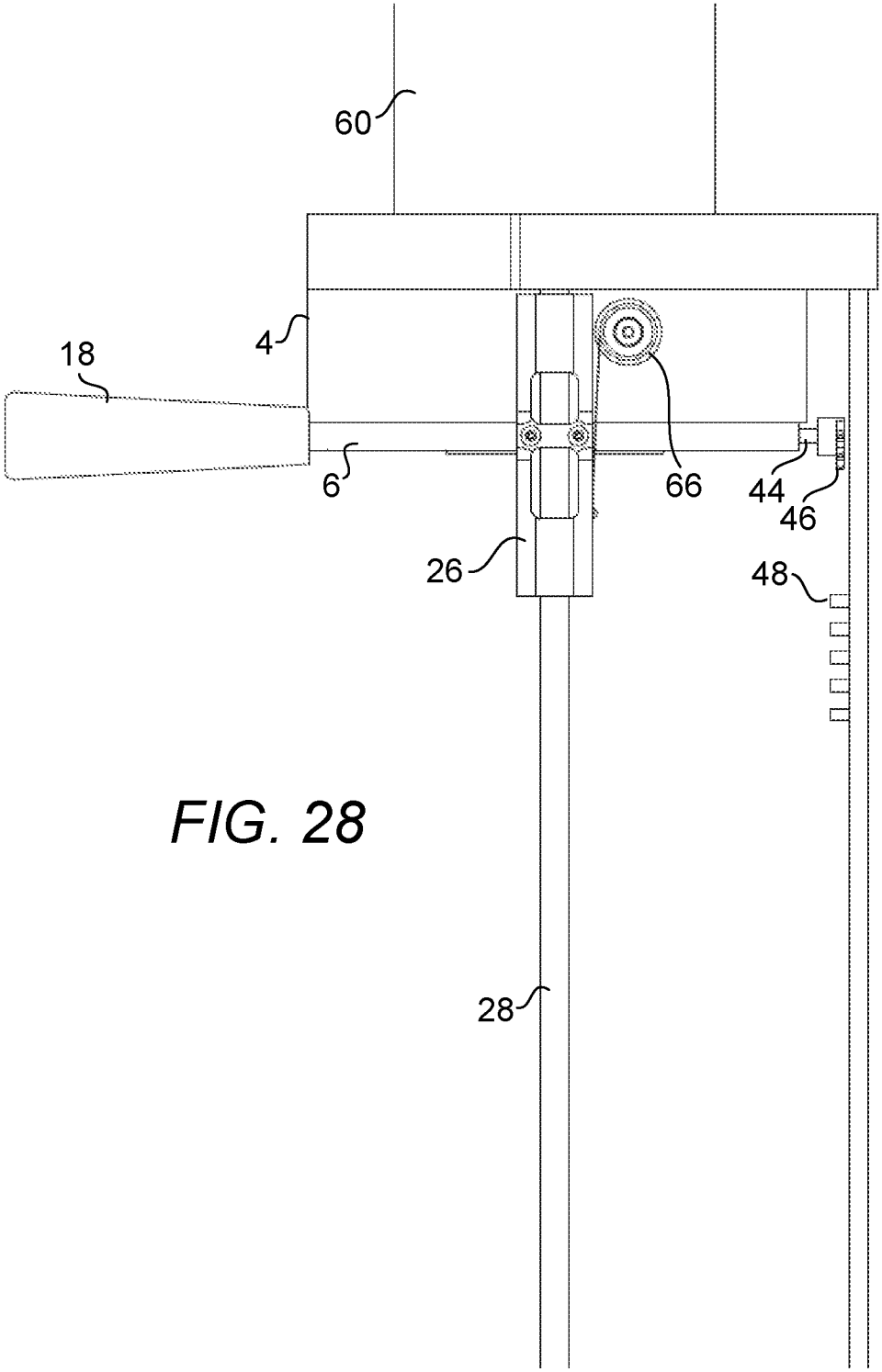
FIG. 28 is a partial side view of one embodiment of a lid application device, depicting a return spring that has returned a press assembly to its at-rest position.
Figure 29:
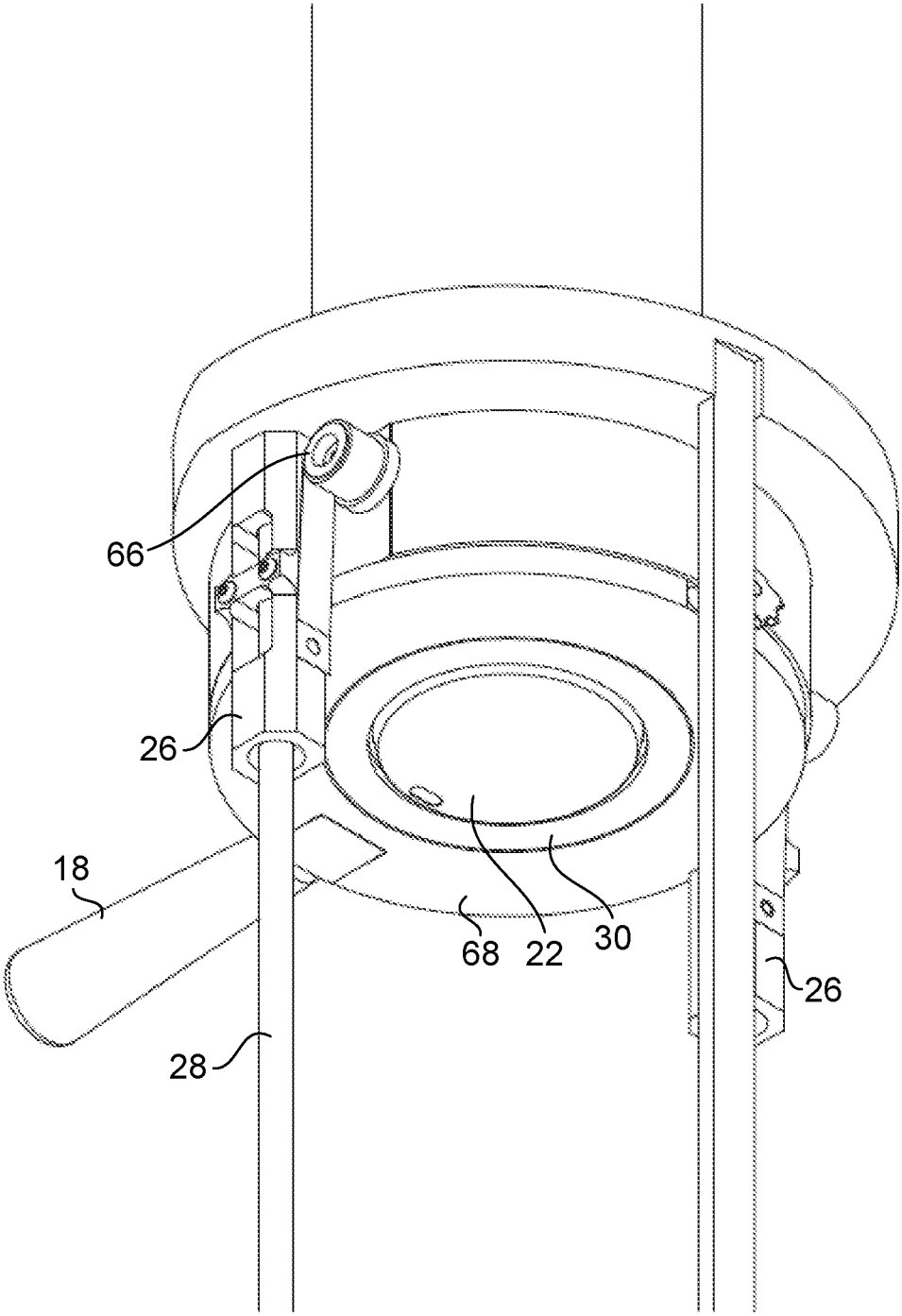
FIG. 29 is a partial bottom rear view of the embodiment shown in FIG. 28.

FIG. 26 is a partial side view of one embodiment of a lid application device, depicting a return spring 66 connected to a press assembly that is ready to return the press assembly to be coupled with a dispense assembly once the handle 18 is released. FIG. 27 is a partial bottom rear view of the embodiment shown in FIG. 26. FIG. 28 is a partial side view of one embodiment of a lid application device, depicting a return spring 66 that has returned a press assembly to its at-rest position. FIG. 29 is a partial bottom rear view of the embodiment shown in FIG. 28. The return spring 66 is essentially a tape spring with one of its ends attached to the press assembly although other mechanisms may be used, e.g., a coil spring, etc.

Figure 30:
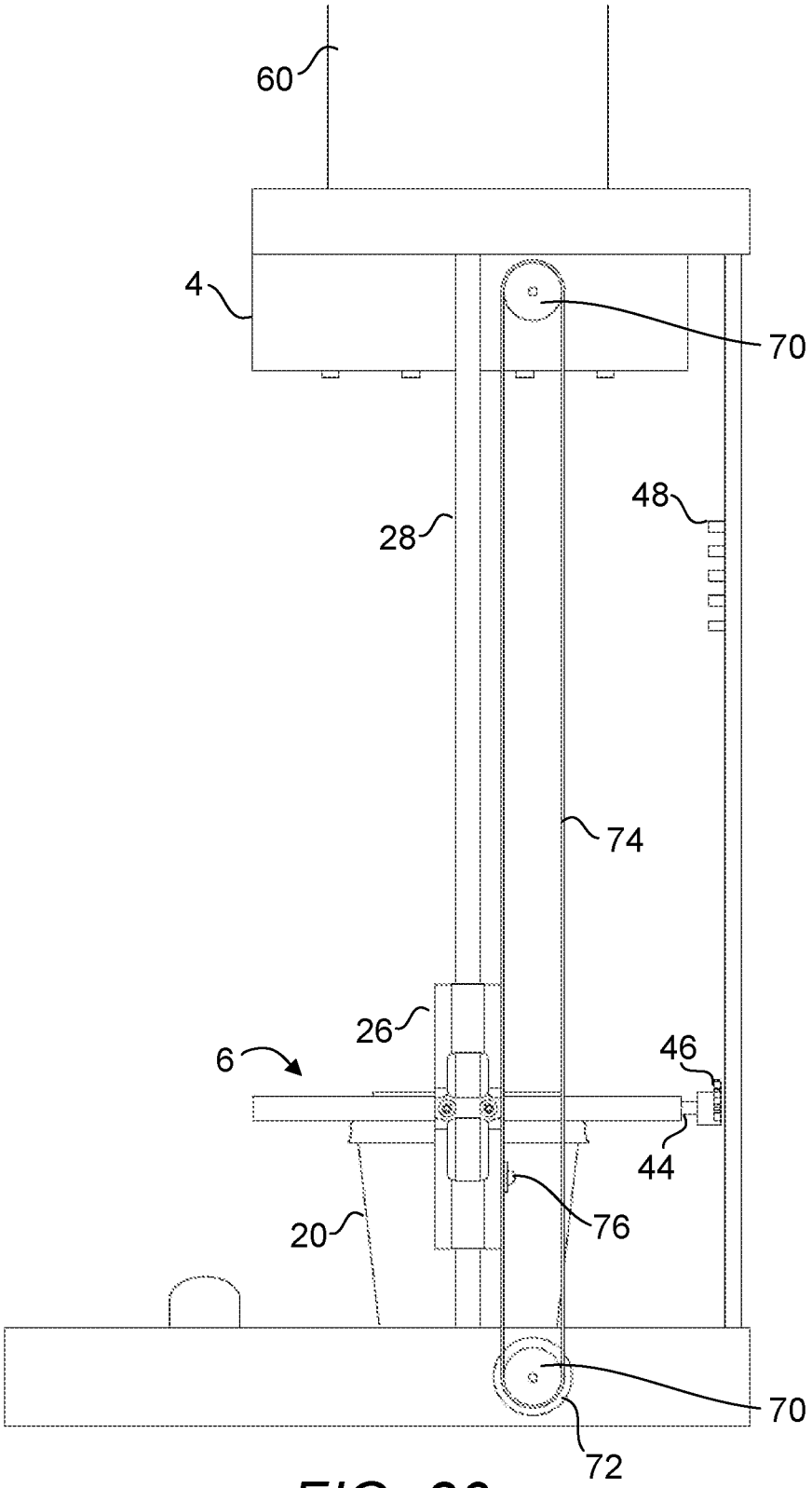
FIG. 30 is a partial side view of a transport assembly of present device, depicting an alternative means for transporting the press assembly.
Figure 31:
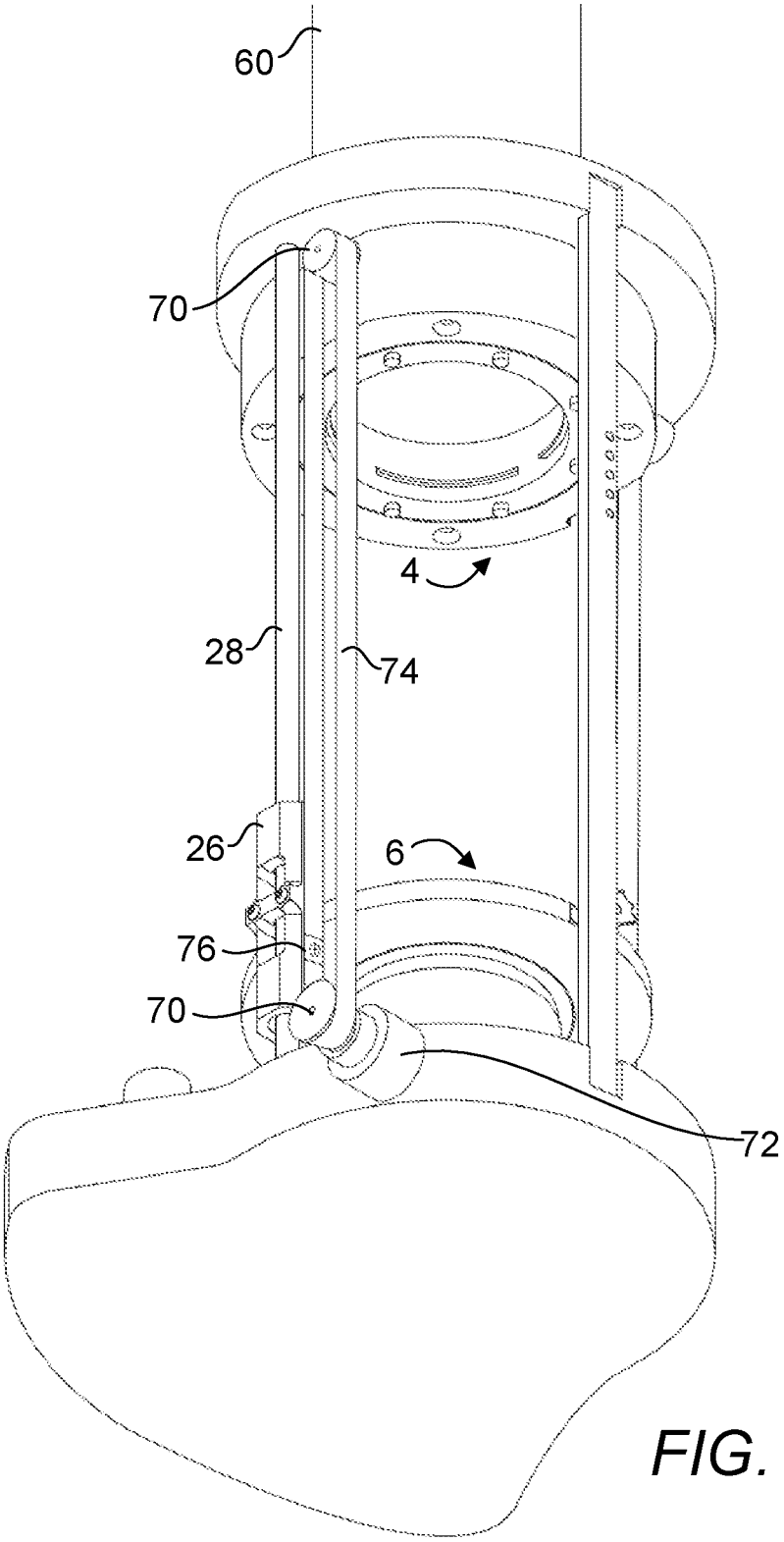
FIG. 31 is a partial bottom rear view of a transport assembly of present device, depicting an alternative means for transporting the press assembly.

FIG. 30 is a partial side view of a transport assembly of present device, depicting an alternative means for transporting the press assembly. FIG. 31 is a partial bottom rear view of a transport assembly of present device, depicting an alternative means for transporting the press assembly. In this embodiment, the act of seating a lid on a cup is automated or partially automated. A pulley system is provided. A first pulley 70 is attached to the dispense assembly at the top of the device and a second pulley 70 is connected to a motor 72 disposed at the base of the device. A belt 74 connects the two pulleys 70 and attached to the bushing 26 at attachment point 76. When turned on in one direction, the motor 72 drives the press assembly that is connected to the bushings 26 to be coupled with the dispense assembly. When driven in the opposite direction, the motor 72 drives the press assembly to seat a lid onto a cup.

The present lid application device may be used in non-beverage applications, e.g., ice cream novelties, milkshakes, and desserts served in a cold beverage container and any applications requiring well-sealed vessels, etc.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A container lid application device for applying a lid onto a container, said lid application device comprising:

(a) a dispense assembly configured for indexing the lid from a magazine of lids in a first orientation, said magazine of lids terminated at a bottom end of said magazine of lids with a bottommost lid, said dispense assembly comprising at least two magazine support segments biased toward one another forming an opening, each of said at least two magazine support segments is coupled to a plunger such that when each said plunger is urged upwardly, said opening is widened to release the bottommost lid of said magazine of lids before said opening contracts to support the remaining lids of said magazine of lids;

(b) a press assembly comprising:

(i) a lid grasping ring disposed in a first plane, said lid grasping ring comprising a ring member configured for receiving the bottommost lid, said ring member having an opening of a first diameter; and (ii) a handle attached to a support ring within which said lid grasping ring is disposed;

(c) a transport assembly comprising:

(i) a guide slideably attached to said support ring, said guide configured for guiding said lid grasping ring to the container at a first position in a first direction;

(ii) a return spring attached to said support ring, wherein said return spring is configured to return said lid grasping ring to a second position in a second direction opposite to said first direction; and (d) a rotator assembly configured for rotating said lid grasping ring to a second orientation that is disposed at about 180 degrees with respect to said first orientation while said press assembly is moved between said first position and said second position, wherein, when said handle is pulled away from said second position towards said first position with a force, said plunger drops downwardly, the released bottommost lid is received in said opening of said ring member, the released bottommost lid is rotated by said rotator assembly while being transported by said transport assembly before arriving at said first position such that the released bottommost lid is securable to the container by said press assembly.

2. The container lid application device of claim 1, further comprising a force limiter configured for bridging said handle and said lid grasping ring, said force limiter comprises a resilient member having two ends, a first end of said resilient member is attached to said handle and a second end of said resilient member is attached to said support ring, wherein if said force exceeds a pre-determined threshold, said handle is rotated about said resilient member in said first direction to prevent continued application of the force and wherein if said handle is released, said press assembly is returned to said second position by said return spring, urging said plunger upwardly to release a next bottommost lid into said opening of said ring member.

3. The container lid application device of claim 1, wherein said lid grasping ring further comprises a support ring interposed between said lid grasping ring and said guide, a first magnet disposed in said first plane and a second magnet disposed in said support ring, wherein said first magnet is configured to be attracted to said second magnet, thereby aligning said first plane with the container.

4. The container lid application device of claim 1, wherein said press assembly further comprises a protruding ring disposed in a second plane, said protruding ring having an opening of a second diameter that is smaller than said first diameter, said second plane is disposed parallel to and at an offset to said first plane, wherein said protruding ring is configured to come in contact with a portion of the released bottommost lid such that the force can be uniformly applied on the released bottommost lid to secure the released bottommost lid to the container.

5. The container lid application device of claim 1, wherein said resilient member is a component selected from the group consisting a torsion spring, a flexible rod, a coil spring and any combinations thereof.

6. The container lid application device of claim 1, wherein the force is exerted manually.

7. The container lid application device of claim 1, wherein said transport assembly further comprises a pulley system adapted to cycle said transport assembly between said first position and said second position without a manual effort.

8. The container lid application device of claim 1, further comprising a shield disposed around the magazine of lids, preventing human interactions with the lids.

9. A container lid application device for applying a lid onto a container, said lid application device comprising:

(a) a dispense assembly configured for indexing the lid from a magazine of lids in a first orientation, said magazine of lids terminated at a bottom end of said magazine of lids with a bottommost lid, said dispense assembly comprising at least two magazine support segments biased toward one another forming an opening, each of said at least two magazine support segments is coupled to a plunger such that when each said plunger is urged upwardly, said opening is widened to release the bottommost lid of said magazine of lids before said opening contracts to support the remaining lids of said magazine of lids;

(b) a press assembly comprising:

(i) a lid grasping ring disposed in a first plane, said lid grasping ring comprising a ring member configured for receiving the bottommost lid, said ring member having an opening of a first diameter; and (ii) a handle attached to a support ring within which said lid grasping ring is disposed;

(c) a transport assembly comprising:

(i) a guide slideably attached to said support ring, said guide configured for guiding said lid grasping ring to the container at a first position in a first direction;

(ii) a return spring attached to said support ring, wherein said return spring is configured to return said lid grasping ring to a second position in a second direction opposite to said first direction;

(d) a rotator assembly configured for rotating said lid grasping ring to a second orientation that is disposed at about 180 degrees with respect to said first orientation while said press assembly is moved between said first position and said second position; and (e) a force limiter configured for bridging said handle and said lid grasping ring, said force limiter comprises a resilient member having two ends, a first end of said resilient member is attached to said handle and a second end of said resilient member is attached to said support ring, wherein, when said handle is pulled away from said second position towards said first position with a force, said plunger drops downwardly, the released bottommost lid is received in said opening of said ring member, the released bottommost lid is rotated by said rotator assembly while being transported by said transport assembly before arriving at said first position such that the released bottommost lid is securable to the container by said press assembly, wherein if said force exceeds a pre-determined threshold, said handle is rotated about said resilient member in said first direction to prevent continued application of the force and wherein if said handle is released, said press assembly is returned to said second position by said return spring, urging said plunger upwardly to release a next bottommost lid into said opening of said ring member.

10. The container lid application device of claim 9, wherein said lid grasping ring further comprises a support ring interposed between said lid grasping ring and said guide, a first magnet disposed in said first plane and a second magnet disposed in said support ring, wherein said first magnet is configured to be attracted to said second magnet, thereby aligning said first plane with the container.

11. The container lid application device of claim 9, wherein said press assembly further comprises a protruding ring disposed in a second plane, said protruding ring having an opening of a second diameter that is smaller than said first diameter, said second plane is disposed parallel to and at an offset to said first plane, wherein said protruding ring is configured to come in contact with a portion of the released bottommost lid such that the force can be uniformly applied on the released bottommost lid to secure the released bottommost lid to the container.

12. The container lid application device of claim 9, wherein said resilient member is a component selected from the group consisting a torsion spring, a flexible rod, a coil spring and any combinations thereof.

13. The container lid application device of claim 9, wherein the force is exerted manually.

14. The container lid application device of claim 9, wherein said transport assembly further comprises a pulley system adapted to cycle said transport assembly between said first position and said second position without a manual effort.

15. The container lid application device of claim 9, further comprising a shield disposed around the magazine of lids, preventing human interactions with the lids.

16. A container lid application device for applying a lid onto a container, said lid application device comprising:

(a) a dispense assembly configured for indexing the lid from a magazine of lids in a first orientation, said magazine of lids terminated at a bottom end of said magazine of lids with a bottommost lid, said dispense assembly comprising at least two magazine support segments biased toward one another forming an opening, each of said at least two magazine support segments is coupled to a plunger such that when each said plunger is urged upwardly, said opening is widened to release the bottommost lid of said magazine of lids before said opening contracts to support the remaining lids of said magazine of lids;

(b) a press assembly comprising:

(i) a lid grasping ring disposed in a first plane, said lid grasping ring comprising a ring member configured for receiving the bottommost lid, said ring member having an opening of a first diameter; and (ii) a handle attached to a support ring within which said lid grasping ring is disposed;

(c) a transport assembly comprising:

(i) a guide slideably attached to said support ring, said guide configured for guiding said lid grasping ring to the container at a first position in a first direction;

(ii) a return spring attached to said support ring, wherein said return spring is configured to return said lid grasping ring to a second position in a second direction opposite to said first direction; and (d) a rotator assembly comprising at least one pin connected to said lid grasping ring at a first end and a pinion at a second end and a rack, the pinion configured to be rotatable about a central axis of said pin and rotatably coupled with said rack, wherein said rotator assembly is configured for rotating said lid grasping ring to a second orientation that is disposed at about 180 degrees with respect to said first orientation while said press assembly is moved between said first position and said second position, wherein, when said handle is pulled away from said second position towards said first position with a force, said plunger drops downwardly, the released bottommost lid is received in said opening of said ring member, the released bottommost lid is rotated by said rotator assembly while being transported by said transport assembly before arriving at said first position such that the released bottommost lid is securable to the container by said press assembly.

17. The container lid application device of claim 16, further comprising a force limiter configured for bridging said handle and said lid grasping ring, said force limiter comprises a resilient member having two ends, a first end of said resilient member is attached to said handle and a second end of said resilient member is attached to said support ring, wherein if said force exceeds a pre-determined threshold, said handle is rotated about said resilient member in said first direction to prevent continued application of the force and wherein if said handle is released, said press assembly is returned to said second position by said return spring, urging said plunger upwardly to release a next bottommost lid into said opening of said ring member.

18. The container lid application device of claim 16, wherein said lid grasping ring further comprises a support ring interposed between said lid grasping ring and said guide, a first magnet disposed in said first plane and a second magnet disposed in said support ring, wherein said first magnet is configured to be attracted to said second magnet, thereby aligning said first plane with the container.

19. The container lid application device of claim 16, wherein said press assembly further comprises a protruding ring disposed in a second plane, said protruding ring having an opening of a second diameter that is smaller than said first diameter, said second plane is disposed parallel to and at an offset to said first plane, wherein said protruding ring is configured to come in contact with a portion of the released bottommost lid such that the force can be uniformly applied on the released bottommost lid to secure the released bottommost lid to the container.

20. The container lid application device of claim 16, wherein the force is exerted manually.

* * * * *